US010543144B2

(12) United States Patent
Johnson et al.

(10) Patent No.: US 10,543,144 B2
(45) Date of Patent: Jan. 28, 2020

(54) RECIPROCATING ARM MOTION WALKER

(71) Applicant: NEUROMOBILITY LLC, Coupeville, WA (US)

(72) Inventors: Cynthia Louise Johnson, Coupeville, WA (US); Alan Grantz, Aptos, CA (US)

(73) Assignee: NEUROMOBILITY LLC, Coupeville, WA (US)

( * ) Notice: Subject to any disclaimer, the term of this patent is extended or adjusted under 35 U.S.C. 154(b) by 0 days.

(21) Appl. No.: 15/970,538

(22) Filed: May 3, 2018

(65) Prior Publication Data

US 2018/0250189 A1 Sep. 6, 2018

Related U.S. Application Data

(63) Continuation-in-part of application No. PCT/US2016/060411, filed on Nov. 3, 2016, which is (Continued)

(51) Int. Cl.

| | |
|---|---|
| ***A63B 23/03*** | (2006.01) |
| ***A61H 3/04*** | (2006.01) |
| *A61H 3/00* | (2006.01) |

(52) U.S. Cl.

CPC ..... *A61H 3/04* (2013.01); *A61H 2003/006* (2013.01); *A61H 2003/046* (2013.01)

(58) Field of Classification Search

CPC ... A63B 22/01; A63B 22/067; A63B 22/0676; A63B 22/0688; A63B 23/03533;

(Continued)

(56) References Cited

U.S. PATENT DOCUMENTS 2,362,466 A 11/1944 Carter
3,098,651 A 7/1963 Murcott (Continued)

FOREIGN PATENT DOCUMENTS

DE 10 2007 015 106 A1 10/2008
DE 10 2015117 484 B2 1/2017

(Continued)

OTHER PUBLICATIONS

PCT/US2016/060411 International Search and Written Opinion, dated Mar. 2, 2017.

(Continued)

*Primary Examiner* — Bryan A Evans
(74) *Attorney, Agent, or Firm* — Fay Sharpe LLP

(57) ABSTRACT

A wheeled ambulatory aid for mobility and training which is advanced via bodily contact. Reciprocating UE movement is enabled and reciprocating gait patterns can be performed. The patient mobility aid includes a frame, and at least first and second wheels operatively secured to and supporting the frame for selective rolling movement. First and second support assemblies are located on first and second sides of the frame, respectively. A reverse motion linkage operatively associated with the first and second support assemblies, the reverse motion linkage including a first state configured to provide independent between the first and second support assemblies, and a second state configured to provide inter-related movement between the first and second support assemblies to create symmetrical out of phase reciprocating UE movement. Support assemblies can variably be statically positioned.

26 Claims, 24 Drawing Sheets

Related U.S. Application Data a continuation-in-part of application No. 14/719,311, filed on May 21, 2015, now Pat. No. 9,795,825.

(60) Provisional application No. 62/250,291, filed on Nov. 3, 2015.

(58) Field of Classification Search
CPC ..... A63B 23/03541; A62B 2022/0676; A62B 2022/0688
See application file for complete search history.

(56) References Cited

U.S. PATENT DOCUMENTS

| | | | | |
|---|---|---|---|---|
| 3,442,276 | A | 5/1969 | Edwards et al. | |
| 4,248,256 | A * | 2/1981 | Thomas | A61H 3/00 135/67 |
| 4,529,194 | A * | 7/1985 | Haaheim | A63B 21/012 482/70 |
| 4,587,961 | A | 5/1986 | Ventura et al. | |
| 4,748,994 | A | 7/1988 | Schultz et al. | |
| 5,407,406 | A | 4/1995 | Canela | |
| 5,476,432 | A * | 12/1995 | Dickens | A61H 3/04 135/67 |
| 5,499,955 | A * | 3/1996 | Becker | A61H 3/00 434/255 |
| 5,588,456 | A | 12/1996 | Hart | |
| 6,279,591 | B1 | 8/2001 | Obitts | |
| 6,733,018 | B2 * | 5/2004 | Razon | A61H 3/008 135/67 |
| 7,140,626 | B1 * | 11/2006 | Keay | A63B 21/0004 280/230 |
| 7,422,550 | B1 | 9/2008 | Pinero et al. | |
| 7,494,138 | B2 | 2/2009 | Graham | |
| 7,998,043 | B2 | 8/2011 | Zhou et al. | |
| 8,137,250 | B1 | 3/2012 | Caban | |
| 8,251,079 | B1 | 8/2012 | Lutz et al. | |
| 8,573,612 | B1 | 11/2013 | Fulk et al. | |
| 8,752,658 | B2 | 6/2014 | Kurek | |
| 9,022,397 | B1 * | 5/2015 | Prettyman | B62B 5/0447 280/47.34 |
| 9,351,898 | B2 | 5/2016 | Triolo et al. | |
| 9,795,825 | B2 | 10/2017 | Johnson | |
| 2001/0048206 | A1 * | 12/2001 | Niu | A61H 3/04 280/87.021 |
| 2006/0288810 | A1 | 12/2006 | Vroom | |
| 2008/0079230 | A1 * | 4/2008 | Graham | A61G 5/08 280/87.041 |
| 2014/0209133 | A1 | 7/2014 | Pak et al. | |
| 2015/0335940 | A1 * | 11/2015 | Johnson | A63B 21/1488 248/118 |

FOREIGN PATENT DOCUMENTS

| | | | |
|---|---|---|---|
| EP | 0 624 357 | A | 11/1994 |
| EP | 2 022 454 | A1 | 2/2009 |
| JP | 2007-280709 | A | 10/2007 |
| JP | 2005-058672 | A | 5/2009 |
| JP | 2009 106446 | A | 5/2009 |
| JP | 2013 116146 | A | 6/2013 |
| WO | WO 2017/032376 | A1 | 3/2017 |

OTHER PUBLICATIONS

PCT/US2016/060411 International Preliminary Report on Patentability, dated May 17, 2018.

www.alibaba.com/product-detail/PARALLEL-WALKING-BAR Parallel Walking Bar Delux, 3pp., May 29, 2015.

Alkjaer, et al., "Biomechanical analysis of rollator walking", *BioMedical Engineering OnLine*, 5:2, pp. 1-7, 2006.

Allet, et al., "Effect of different walking aids on walking capacity of patients with poststroke hemiparesis", *Arch Phys Med Rehabil*, V.90:1408-1413, Aug. 2008.

Bateni, et al., Assistive devices for balance and mobility: benefits, demands, and adverse consequences, *Arch Phys Med Rehabil*, V.86:134-145, Jan. 2005.

Behrman, et al., "Locomotor training after human spinal cord injury: a series of case studies", *Phys Ther*, V.80(70):688-700, Jul. 2000.

Behrman, et al., Locomotor training progression and outcomes after incomplete spinal cord injury, *Phys Ther*, V.85(12):1356-1371, 2005.

Berling, et al., The effect of handrail support on oxygen uptake during steady-state treadmill exercise, *J Cardiopulm Rehabil.*, 26(6):391-4, 2006.

www.chinesport.com, *Chinesport General catalogue, Edition 2013, STandGO system*, pp. 236-255.

h/p/cosmos, "Treadmill therapy, early start of therapy with body weight support", date unknown.

Klarner, et al., Exploiting interlimb arm and leg conections for walking rehabilitation: a training intervention in stroke, *HPC Neural Plasticity*, 2016/1517968.

Maguire, et al., "The influence of walking-aids on the plasticity of spinal interneuronal networks, central-pattern generators and the recovery of gait post-stroke. A literature review and scholarly discussion", *Journal of Bodywork & Movement Therapies*, 21(2):422-434, 2016.

Meyns, et al., "The how and why of arm swing during human walking", *Gait Posture*, 38(4):555-562, 2013.

O'Hare, et al., "A systematic review of evidence for the provision of walking frames for older people" *Physical Therapy Reviews* 18(1):11-23 • Feb. 2013.

Posey, et al., "Sliding forearm rest for parallel bars: Suggestions from the Field", *Phys. Ther.* 1983, 63:347-348 (downloaded from http://ptjournal.apta.org on Oct. 3, 2014).

Schulein, et al., "Instrumented gait analysis: a measure of gait improvement by a wheeled walker in hospitalized geriatric patients", *Journal of NeuroEngineering and Rehabilitation*, 14(1), 2017.

Stephenson, et al., "The effect of arm movements on the lower limb during gait after a stroke", *Gait & Posture*, 31(1):109-114, 2010.

Suica, et al., "Walking with a four wheeled walker (rollator) significantly reduces EMG lower-limb activity in healthy subjects", *Journal of Bodywork & Movement Therapies*, 20(1):65-72, 2016.

Tester, et al., "Device use, locomotor training and the presence of arm swing during treadmill walking after spinal cord injury", *Spinal Cord*, 49:451-456, 2011.

Umker, et al., "Effects of handrail hold and light touch on energetics, step parameters, and neuromuscular activity during walking after stroke", *Journal of NeuroEngineering and Rehabilitation*, 12:70, 2015.

Warlop, et al., "Does Nordic Walking restore the temporal organization of gait variability in Parkinson's disease? ", *Journal of NeuroEngineering and Rehabilitation*, 14:17, 2017.

Williams, et al., "Training conditions influence walking kinematics and self-selected walking speed in patients with neurological impairments", *Journal of Neurotrama*, 28:281-287, 2011.

Zehr, et al., "Neuromechanical interactions between limbs during human locomotion: an evolutionary perspective with translation to rehabilitation", *Exp Brain Res*, 234:3059-3081, 2015.

EP 16 86 3009 Supplementary dated Apr. 26, 2019.

* cited by examiner

RECIPROCATING ARM MOTION WALKER

This application is a continuation-in-part of and claims the priority benefit of PCT/US2016/060411, international filing date of Nov. 3, 2016, which claims the priority benefit of U.S. provisional application Ser. No. 62/250,291, filed Nov. 3, 2015, and U.S. utility patent application Ser. No. 14/719,311, filed May 21, 2015, the disclosures of each of which are expressly incorporated herein by reference. This disclosure is directed to wheeled devices used for ambulatory support. Assistive devices such as walkers, rollators, and wheeled devices used for various forms of walking training are railed devices used as mobility aids to improve balance and to reduce lower extremity (LE) loading, for gait and other physical rehabilitation, as therapeutic devices, and for neurorecovery of locomotor function. The interest in physical, physiological, and functional effects of using walkers and rollators and the use of these devices for therapeutic purposes is increasing (O'Hare et al, 2013). The upper extremities (UEs) function abnormally in a postural support role when managing these devices. Multiple solutions for multiple user groups related to wheeled device use are provided for by altering the function of the upper body.

BACKGROUND

An overground mobility aid is needed to enable continuation of gait training and ambulatory activities performed in stable railed environments such as parallel bars and treadmills for those requiring balance support as well as significant upper body support. Normal gait kinematics includes in part, erect posture, reciprocating UE movement (and UEs moving out of phase, and UE movement out of phase with reciprocating LE), and associated trunk rotation. Reciprocating gait also refers to those patterns which incorporate increasing amounts of UE support for the opposite LE (two and four point gait).

The goal when walking with mobility aids is to achieve stability and the most efficient gait pattern. It is understood that weight bearing through the upper limbs is unnatural and is preferentially minimized when using mobility aids.

It is well documented that arm movement when walking is advantageous mechanically to enhance gait efficiency and stability. Trunk rotation is needed for normal LE biomechanics. Neuromechanical connections between upper and lower limbs exist, suggesting neurologic benefit of UE movement during locomotor activities. In part, rhythmical repetitive reciprocating movement during repetitive stepping training is known to enhance recovery of LE function. Arm swing in neurologic gait rehab is recommended (Meyns et al, 2013). Reciprocating UE movement enhances gait velocity, an important indicator of ambulatory ability, a standard gait rehab goal, and often a primary concern of mobility aid users. Furthermore, walking and running with elbows flexed 90 degrees is known to be more efficient. It would be desirable to have a device offering forearm support and enablement of rhythmical reciprocating UE movement.

Arm swinging with mobile grip handle support has been shown to enhance velocity and reduce UE weight bearing on treadmills in comparison to walking with static grip support (Stephenson et al, 2010). Translation of this finding, mobile grips may provide the same benefits if introduced to another form of railed device, framed walking aids. Excessive gripping pressure is associated with UE weight bearing and is understood to create aberrant heart rate and other objective data during treadmill training (Berling et al, 2006). A means to minimize gripping pressure with use of all railed devices, including wheeled mobility aids, would be desirable.

Conclusions drawn from studies examining UE weight bearing and movement during walking on a treadmill may be applicable to railed wheeled devices. Stroke survivors exhibited enhanced gait velocity when walking on a treadmill using mobile grip handles (Umker et al, 2015). Subjects with traumatic brain injury, cerebro vascular accident (CVA) or stroke, and multiple sclerosis were able to walk faster when gripping a rail instead of walking without UE support (Williams et al, 2011). A walker with mobile grip handles on the upper rails is needed.

It has been shown that walking with mobility aids which enable reciprocating UE movement is correlated with enhanced UE movement when not using or when no longer needing to use the assistive device (Tester et al, 2011). It would be desirable if a wheeled device enabled more natural UE movement irregardless of the amount of support needed.

Crutch use enables reciprocating arm movement yet requires additional coordination and provides less support than a walker. Full shoulder and hip extension range of motion (ROM) are often not achieved with use, hence biomechanics are compromised. When minimal weight bearing support is needed, yet reciprocating gait pattern is desired, such as with exoskeleton use and body weight support, crutches do not enable rhythmical repetitive UE movement. Canes enable UE movement yet may not provide adequate support.

Carter (U.S. Pat. No. 2,362,466) discusses a walker which provides for active alternating rotational movement of the upper torso. The user statically grips the side rails and axillary supports (supports under armpits/axilla or 'crutch-like' support assemblies) oscillate about fixed points on the side frame. Movement of one side of the upper body does not create equal and opposite motion of the second side and good bilateral UE function is needed for use. Reciprocating movement of an UE upon the frame is not created. In addition, mobile grips/grip handles or mobile forearm supports are not mobile upon the side frame(s). Schultz (U.S. Pat. No. 4,748,994) describes a device with UE support assemblies which can be repositioned along the side rails prior to use yet assemblies are statically positioned during use and statically positioned UEs manage the device.

Pak (U.S. Pat. No. 8,726,922), Murcott (U.S. Pat. No. 3,098,651) and Edwards (U.S. Pat. No. 3,442,276) discuss walkers with hinged connections between the front and side frames. The application of these devices is limited to users with good bilateral UE function. Features do not facilitate alternating UE movement. LE movement which is in phase with reciprocating UE movement as opposed to out of phase, is facilitated with these devices related to the positioning of the front frame member when one side is advanced. Wheels must be introduced in order to perform more rhythmical UE movement. This presents stability concerns particularly with increased UE weight bearing.

Rollators are three or four wheeled devices increasingly being used by an aging population wishing to remain strong and active. Users often desire to walk with a gait pattern which is as natural as possible. Grip handles or forearm supports are typically statically and symmetrically positioned on these devices, which is unnatural. Stability is lacking compared to devices with two wheels. A stable device enabling more natural gait pattern is needed.

Devices requiring good bilateral UE function and advanced via reciprocating UE movement against resistance may have limited application to the fit, healthy population.

Vangsgaard (WO 2017032376) presents a device with levers which drive front or rear wheels. Features do not provide constraint for slaloming. Kochs' (DE10201511748483) device provides levers pushed by the UEs against resistance and this causes forward movement of the device. Judjahn (DE 102007015106) and JP 2009106446) also present devices with levers gripped by the user to drive the wheels. A device is needed which enables a more natural gait pattern and does not rely on good upper body function to manage. A device is needed which could variably be used to enhance upper body strengthening by addition of resistance mechanism to the mobile component.

A common concern related to use of walkers and rollators is the flexed posture associated with use. UE forces can be directed horizontally parallel to the ground and erect posture achieved when used for balance support. Weight bearing through UEs necessitates anterior displacement of the center of gravity because the UEs simultaneously advance the device and this is accomplished by forward leaning or flexing the spine and/or hips. Forearm supports can be used to facilitate more erect posture and reduced UE weight bearing yet if used for more than light support, upper body forces are necessarily directed angled downward. A paradigm shift in how mobility aids are managed is needed. A walker and rollator is needed which is advanced via bodily contact instead of being managed by the UEs.

When light/balance support is needed, it would be desirable to have a wheeled mobility aid or rehab or therapeutic device which is advanced preferentially by bodily contact which could be used with statically positioned UEs as well as with mobile UEs.

Continuous stepping with a wheeled device involves more hip extensor activity yet hip extension range of motion is typically reduced and kinetics are altered. When discontinuous stepping patterns are performed, even when walking with light upper body support, the UEs may be used to provide bracing to facilitate hip flexion to advance a LE instead of activating hip extensors to a greater extent. Bateni et al. (2005) discuss the potential for variability in horizontally directed (propulsive or braking) forces with use of walkers. It would be desirable to have features which facilitate enhanced lower body propulsion to advance the device.

Static UE positioning does not enable performance of compensatory gait patterns which may be performed in parallel bars. This is unsafe and inefficient. A device is needed which enables gait patterns achievable in parallel bars for safety and efficiency. It would be desirable to have a wheeled walker with braking capability which enabled alternating UE movement and more vertically directed upper body forces for provision of support.

Suica et al (2016) and Maguire (2017) note that excessive compensatory use of UEs is common with rollator use and this may negatively impact LE strength over time. Alkjaer et al (2006) also found significant alterations in LE muscular function with rollator use. Rollator use is particularly desirable to those wishing to remain independent. LE strength is integral to functional independence. A rollator solution is needed which provides for more normalized LE function.

Walking ability with wheeled devices necessarily in part reflects upper body function. Also, adequate upper body function is needed to use wheeled devices. Minimization of UE management would be desirable in order to be able to more accurately assess lower body functional status. Such a device could be used as a screening tool for fall risk associated with use of a particular type of wheeled device.

Schulein et al (2017) discuss the importance of delineating the impact of walker use on gait parameters known to directly impact falls in the elderly population. Excessive UE management of these devices significantly impacts measures reviewed in these papers. UE management of mobility aids places additional cognitive demands and may be particularly detrimental in the presence of cognitive impairment.

For a given amount of physical work, energy expenditure is greater when the same amount of work is performed by UEs as compared to the LEs. It is well known that energy expenditure related to UE management of mobility aids is considerable. It would be desirable if a wheeled device could be advanced via bodily contact instead of by UE management.

Increased use of forearm supports on wheeled devices is needed as well as a device which enables improved ambulation with use of this type of UE support surface. Assemblies predominantly are available for attachment to standard devices, thereby introduced without hand brakes. Stability is often a concern related to need to be used on a wheeled device, and typically one with swivel wheels to enable steering. Support surfaces typically are not ergonomically designed to accommodate UE dysfunction. A mobility aid with various types of readily interchangeable grip and forearm support assemblies with hand brakes is needed. Other walkers and rollators which enable reciprocating UE incorporate gripping support. A device which enables all of the reciprocating gait patterns whilst one or both forearms is supported is needed. Training in proper biomechanics in all orthopedic gait rehabilitation including following total hip and total knee replacement is significantly compromised when using standard walkers and rollators. It would be desirable to have a gait training device which encouraged normal hip and knee function.

Prior art focused on devices for use in gait training includes devices propagated by work performed by the upper body [Lutz (U.S. Pat. No. 8,251,079). Albani et al (EP0624357) Katamoto (JP 2013116146)]. A device which normalizes upper and lower body movement whilst minimizing UE work is needed.

Pinero (U.S. Pat. No. 7,422,550) presents a training device which addresses the need for facilitation of reciprocating LE movement. A device which mechanically mobilizes the UEs in reciprocating manner is needed.

Exaggerated upper limb movement to improve locomotor ability following neurotrauma is discussed in the art (Zehr et al, 2016). Current solutions for creating exaggerated and/or repetitive reciprocating UE during repetitive stepping training over ground and on the treadmill includes holding and moving poles parallel to the ground. This requires adequate UE function and physical assistance. A mechanical means is needed to enable UE movement during long duration stepping activities is needed. This feature would enhance UE movement symmetry. It is well known that fall risk in the elderly is correlated with gait asymmetries. It would be desirable to have a device which could be used for daily training to enhance gait symmetry.

Specifically related to Parkinson's Disease (PD), incorporation of reciprocating UE movement and associated trunk rotation in rehab is advised. The UEs are statically positioned on current devices designed for the PD population. Decreased arm swing is one of first physical signs of the disease. A device which could be used throughout the course of this progressive disease would enable freely reciprocating UE movement as well as a means to potentiate this movement in later stages. The same device could be used in sitting and standing. It would be desirable to have locking wheels for stationary activities.

Warlop et al (2017) recommend incorporation of rhythmic external audible cuing to bypass the basal ganglia in PD. Audible cuing is also advised for spinal cord injury (SCI) gait rehab. Reciprocating UE movement would provide a functionally relevant means to accomplish this.

Stroke (CVA) gait rehab is the largest cause of gait dysfunction in the U.S. A device is needed which enables a stronger UE to mobilize a weaker UE in reciprocating fashion. A mechanical means to incorporate the upper body into gait rehab is needed. An adequately supportive device which facilitates work on upper and lower body symmetry is needed. Such a device could also be used for bilateral UE training in sitting.

Typically in the case of unilateral UE dysfunction, the involved UE is statically supported or unsupported and not mobilized when using a cane or hemiwalker. A mobility aid which does not require good upper body function, as well as enablement of walking similar to that performed in parallel bars would be desirable for CVA gait rehab (Allet et al, 2009). Klarner et al (2016) discuss the unmet need to incorporate UE movement in CVA gait rehab.

Suica et al (2016) write that current walkers and rollators which enable excessive stability provision by the UEs thereby diminishing physical challenge to the LEs may not be optimal devices to use for stroke (CVA) rehab. It would be desirable to have a training device and mobility aid which enabled UE movement and adjustability of this movement in order to alter stability.

Recent findings related to plasticity of the nervous system have expanded endeavors to improve gait function in those with neurologic disorders. Training involving repetitive stepping training is called locomotor training. Behrman et al (2000) list principles known to enhance locomotor training. This list includes: "(1) generating stepping speeds approximating normal walking speeds (0.75-1.25 m/s) (2) providing the maximum sustainable load on the stance limb (3) maintaining an upright and extended trunk and head (4) approximating normal hip, knee, and ankle kinematics for walking (5) synchronizing timing of extension of the hip in stance and unloading of limb with simultaneous loading of the contralateral limb (6) avoiding weight bearing on the arms and facilitating reciprocal arm swing (7) facilitating symmetrical interlimb coordination, and (8) minimizing sensory stimulation that would conflict with sensory information associated with locomotion." Problems associated with walkers as related to adhering to these principles are addressed by Behrman et al (2005), which describe challenges adhering to these principles with currently available mobility aids.

Maguire et al (2017) present problems related to rollator use related to neurologic gait rehab. LE muscular activity, hip loading, and hip extension range of motion are reduced, excessive use of the UEs is predominant, and collision of rear wheels with feet serve as confusing cutaneous inputs. A device advanced by the body instead of by the UEs is advised.

Even in the presence of normal upper body function, performing repetitive stepping activities on treadmills and when standing, or walking over ground with body weight support, patients may tend to statically position UEs. It would be desirable to have a device which enabled, facilitated, and potentiated reciprocating UE movement for repetitive stepping activities over ground or when on the treadmill. It would be desirable to have a device which could also be used to perform reciprocating gait patterns involving heavier UE support, such as with forearm supports. Such a device could be used for training to minimize UE weight bearing when light support is needed and would enable the same biomechanics when heavier support is needed in the absence of deweighting devices.

Fulk et al. (U.S. Pat. No. 8,573,612) present a device to address the above principles. The device is managed by the UEs, with statically positioned grips on the frame; neither reciprocating movement of one UE or symmetrical out of phase UE movement can be facilitated; device is lacking in stability for safe use when more than light support is needed.

A device is needed which enables enhanced adherance to a greater number of principles known to enhance neurorecovery.

A need exists for an improved arrangement which provides solutions for the above problems as well as others.

SUMMARY OF THE DISCLOSURE

The technical problem is how to reduce UE management of wheeled mobility aids and enable reciprocating UE movement.

Improved gait is achievable with mobile upper extremity (UE) support and related methods in other railed devices such as parallel bars and treadmills by altering upper body function, and an over ground mobility aid is needed which enables the same.

The solution is one or both UE support assemblies can be mobile upon the upper portions of side frames of a device with rigid interconnections between the frame panels. A mobile support assembly comprised of a mobile component and attached UE support assembly is able to reciprocate (move back and forth) along the upper part of one or both side frames along a straight or curvilinear path. UE support surfaces such as grip handles and forearm support assemblies or other can be incorporated in any combination. Brake levers are preferably provided on grip handles and handle portions of forearm support assemblies for use as needed to brake the wheels and/or movement of the assembly upon the rail. An interconnecting member (reverse motion linkage) creates equal and opposite movement of one support assembly relative to the second support assembly. Disconnection of this reverse motion linkage enables independent movement of support assemblies. Introduction of an external power source to movement of one assembly upon its rail or to the reciprocating linkage can readily be introduced. Positioning of motion stop blocks adjacent to mobile components enables one or both support assemblies to be statically positioned. Variable static positioning of assemblies in the sagittal plane can be accomplished. Positioning at other locations along the track provides a way to delimit excursion range of motion. One or more novel frame components identified as torso bar(s) are attached to the frame for contact with user's anterior torso. Vertical positioning of the torso bar (above or aligned with pelvis) is adjusted to optimize walking performance. Positioning at the level of the hip joint may encourage enhanced LE propulsion. A belt or other means of encouraging secure and consistent bodily positioning relative to the torso bar is provided and can be variably incorporated. The device is advanced via bodily contact. The device has two or more wheels. Wheel locks can be incorporated for use for static activities. A preferred embodiment introduces caster wheels to the rear legs.

A wheeled ambulatory aid (such as a walker/rollator) is provided which is advanced via contact with an advancing body (torso). This provides multiple advantages of reduced use of the UEs to manage a mobility aid. Good upper body function is not needed, posture is improved, UE physiological work and excessive upper body weight bearing are likely reduced, training to minimize UE weight bearing can be performed. When used for light support, UEs can be statically positioned or mobile. Static positioning can be accomplished by placement of motion stop blocks adjacent to the assembly(ies). When additional upper body support is needed and gait patterns performed with alternating UE movement, forward movement of the torso related to weight shifting advances the device. Horizontal force development and erect posture are encouraged. Enhanced LE muscular activity with rollator use may occur. Hip extension range of motion is increased. Assessment of ability to walk safely with a wheeled device is enhanced. Visual and physical cues are provided to encourage forward movement of the pelvis (or abdomen) and consistent positioning relative to the frame is accomplished.

Reciprocating movement of one or both support assemblies in the sagittal plane enables reciprocating UE movement of one or both UE as well as a means to achieve out of phase UE movement. An assembly is provided which can be mobile upon a track, rail, or any other configuration allowing back and forth movement on the upper surface of a wheeled device frame. Motion stop blocks prevent movement of assemblies off of tracks and can be used to delimit excursion range. Rhythmical movement can be accomplished when UEs are lightly supported and a more natural gait pattern can be achieved with the adequate support of a framed device, and particularly with a device with wheels on all legs to facilitate continuous stepping. Rhythmical movement can be accomplished with a mechanical linkage intact for consistently symmetrical movement, or with linkage disconnected which allows greater freedom of movement. Rollator users with mild age related gait impairment may selectively use the device with UE movement enabled when walking longer distances and statically position the support assemblies for walking shorter distances such as in the home.

Mobile gripping surfaces or grip handles or mobile forearm supports can be incorporated for UE positioning similar to arm swinging or with flexed elbow which may be desirable for training in faster walking. Horizontally directed UE forces when lightly supported may enhance forward propulsion. This device can be placed over treadmills, used at the edge of a chair or edge of a bed to enable training in functionally relevant upper body movement when standing or marching in place. Introduction of a resistance component provides additional UE training benefit.

UE movement in the sagittal plane enables reciprocating gait patterns incorporating additional UE support. Two and four point gait patterns, variations thereof depending on individual movement patterns which may include compensatory movement, can be performed. Hand braking can be incorporated on one or both sides as needed or desired. Advancing an UE concurrently with (two point gait) or before (four point gait) the opposite LE enables UE forces to be directed perpendicular to the ground. Connection of the reciprocating linkage results in equal and opposite movement of the UEs, with movement of one UE behind the plane of the body. Disconnection of the linkage when performing these gait patterns enables increased freedom and asymmetry of movement. For example, an UE can remain parallel to the torso instead of moving in the rearward direction when the opposite UE is advanced. Independent movement of the assemblies also enables three point gait patterns which will be described. Users with adequate cognition to use the device for this purpose may walk with improved posture and safety. A device is provided which enables a wide range of movement patterns and related UE support needs.

A device which provides a mechanical means to achieve symmetrical bilateral UE movement (via the reverse motion linkage) provides a way to incorporate a motor which might be particularly beneficial for training in longer duration repetitive stepping training when light support is needed as well as repetitive stepping training and movement facilitation when additional support is needed. Repetitive movement of lightly supported UEs may be used when LE function is adequate, or when any of various deweighting devices such as exoskeletons or body weight support is used. Mechanical facilitation of repetitive movement provides a way to adjust stepping cadence, velocity, excursion of movement, and may enable increased duration of walking activities related to decreased cognitive and physical demands to move the UEs for long durations. The reciprocating mechanism provides a way for a stronger UE to mobilize a weaker UE during walking, or for both UEs to be mobilized in the presence of bilateral UE dysfunction. This feature provides an effective tool for training symmetrical upper and lower body movement.

The reciprocating linkage and/or the movement of support assemblies provides a functionally relevant mechanism to integrate LE orthotic devices such as reciprocating gait orthoses as well as more advanced orthotic devices and to integrate various physical cuing mechanisms such as audible cuing or other.

The torso bar can be positioned for fit and function. Consistent bodily positioning relative to the frame provides for safer turning, and prevents foot contact with wheels. Connection of the torso bar to the frame could include spring loaded or other mechanisms in order to enable a selected amount of freedom of movement between the user with secured torso bar and the frame. This may be beneficial when using the device on uneven terrain or to accommodate gait patterns with excessive vertical displacement of the center of gravity.

A walker is provided with a preferred wheel configuration including standard wheels in the front to prevent side to side movement of the device when arms are moving. Swivel wheels in the rear enable turning. The device is turned by moving the rear frame away from the direction of the turn instead of moving the front end of the frame in the direction of the turn. Consistent improved positioning of the body relative to the device in conjunction with wheel configuration may reduce instability and associated fall risk related to traditional rollator use with excessive UE weight bearing and device too far away from the body. A device is provided which can be used with standard wheels in the front and legs without wheels in the rear. A device is provided which can be used with casters in the front and standard wheels in the rear. This configuration may be desirable when UE support assemblies are statically positioned. A device is provided which enables efficient integration of any combination of UE support surface (gripping surfaces, forearm support). The device provides for straight or curved rails. Curved rails enable rotatory shoulder motion and may be particularly useful with incorporation of forearm supports. A rollator with this configuration could be uniquely used for activities such as outdoor rollator walking similar to racewalking. Exaggerated UE movement when forearms are supported encourages enhanced trunk rotation when walking with a railed device. This type of training may be particularly beneficial for the PD population. A device with two forearm supports which enables movement of at least one UE provides a device which enables enhanced maneuverability and functionality when bilateral forearm support is desirable.

A device is provided which can be used with hand braking on one or both sides, and in combination with a grip handle or forearm support. Various configurations provide for various user needs and functional requirements. One lever can actuate one or both wheels and/or brake the movement of the mobile assembly along its path. A device is provided which may enhance neurorecovery as follows: walking at higher velocities is facilitated by UE movement, functionalities associated with the mechanical linkage, and other; enhanced LE weight bearing by enhanced symmetry related to reciprocating UE movement and reduced UE weight bearing; erect posture via incorporation of the torso bar; improved LE kinematics and hip extension range of motion via these same features; reduction of UE weight bearing facilitated by changing UE function related to management of the device; reciprocating UE motion and related work on interlimb coordination is mechanically enabled and can be variably facilitated or potentiated by movement of the opposite UE or by an external power source; and/or consistent positioning relative to the device reduces LE contact with the wheels when walking over ground.

A wheeled device is provided which can be used as a mobility aid by users such as the elderly who have mild age related gait impairment as well as by severely disabled users. A device is provided which can be used as a gait and general rehabilitation device in all patient populations. A device is provided which provides multiple ways to improve training in CVA, PD, and other neurologic disorders. A device is provided which provides therapeutic benefit for many types of users. A device is provided which can cost effectively be introduced into clinical and home settings for efficient and effective continuation of care.

A device is provided which can be folded for easier transport and storage. A walker is provided which can include a seat. A walker is provided into which instrumentation and mechanization components related to UE weight bearing and movement can be added. A walker is described which can be fabricated with various sizes, shapes, and weights of frame components. A device is provided to which additional weight could be added to the exterior of the frame for additional training benefit.

A device is provided which has two or more wheels. A device is provided with front wheels which could be variably positioned, aligned with rear legs/wheels of the device, or positioned in the midline of the device.

Another type of wheeled device, a standing frame, is provided which enables reciprocating UE movement and multiple benefits of UE movement during supported standing activities.

A walker is provided which offers still other features and benefits.

BRIEF DESCRIPTION OF THE DRAWINGS

FIG. 13D is a push pull cable linkage, a variation of which is incorporated into a first and third embodiment and FIG. 13B depicts a timing belt/pulley linkage, a variation of which is incorporated into a second embodiment.

DETAILED DESCRIPTION

Figure 1:
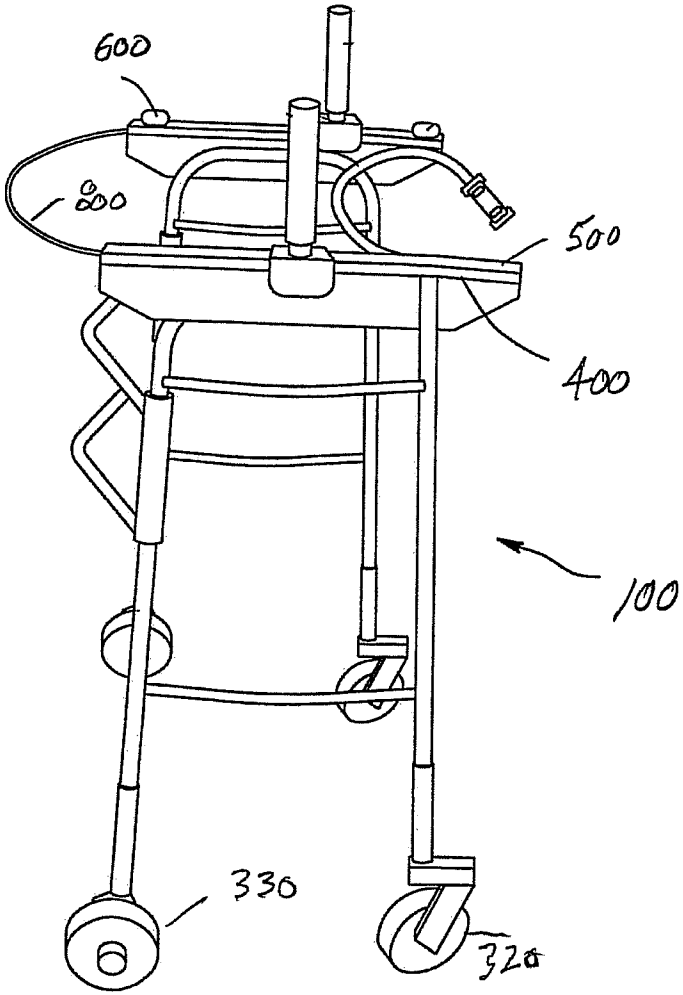
FIG. 1 is a side view of the first embodiment of the improved walker.

Two forearm support assemblies, two grip handles, or one grip handle and one forearm support assembly are selected for use. Brake levers may variably be used with a front wheeled embodiment of the device yet are preferably introduced to devices with more wheels for stability purposes. Appropriate braking configuration is selected. Resistance to glide of the mobile housing could be incorporated and selected. For use as a training device, incremental weight could be added to the frame. Walker height and positioning of support surfaces is adjusted for fit and function. Integration of grip handles which can be positioned horizontally, vertically, and in angled fashion is desirable in terms of accommodating a wide array of user needs. Curvilinear or straight rails/tracks can be incorporated, and may be interchangeably introduced on a single device. The torso bar is positioned fore/aft for optimal positioning of feet within the frame and positioned vertically to optimize contact location on anterior torso. A vertical position level with the hip joint may be desirable in terms of facilitating forward movement of each hemipelvis in turn. Positioning of each of the two support assemblies along the rail is selected for fit and function and the assembly is statically positioned by positioning motion stop blocks on or adjacent to the support assemblies. Walking can be performed with statically positioned UEs in this position. The reverse motion linkage mechanism is attached or engaged for use of the device with bilateral symmetrical reciprocating movement. With the linkage intact, the starting position of the assemblies reflects the mid position of each of the two assemblies during reciprocating movement. Typically, the upper arm will be aligned with the lateral trunk of the user in the starting position yet positioning could be more forward. Disconnection of the linkage enables one UE and associated support assembly to move independently of the second assembly. This allows for asymmetrical movement as well as static positioning of one limb while the other limb moves. The belt is variably secured around the user and provides enhanced management of the device. A quick release mechanism can be introduced to this feature for safety purposes.

The device advances as related to progression of the torso irregardless if UE support assemblies are statically positioned or if UE movement is enabled. Upper body forces directed downward and forward in order to advance the device are discouraged. A more rearwardly placed torso bar and/or more forwardly positioned UE supports would enable increased compensatory use of the upper body if indicated or desired for any reason.

Walking with light support can be performed with static or mobile UE support assemblies. The user is encouraged to rest UEs lightly on UE support assemblies while stepping. The need for additional upper body support necessitates enablement of movement of the support assemblies in alternating fashion or walking with two or four point gait pattern and in symmetrical fashion for walking with a three point gait pattern. The UEs can assist with steering when assemblies are statically positioned.

When light support is needed, UEs can be moved in repetitive reciprocating fashion.

Two and four point gait patterns can be performed with the mechanical linkage connected or disconnected. Hand braking can be used for added stability as needed. Three point step to gait pattern is performed by advancing both assemblies, braking, stepping with the first foot, releasing the brakes and advancing the second foot even with (step to) or past (step through) the first foot. Turning is accomplished by turning the rear of the device in a direction opposite the direction of the turn.

Figure 2:
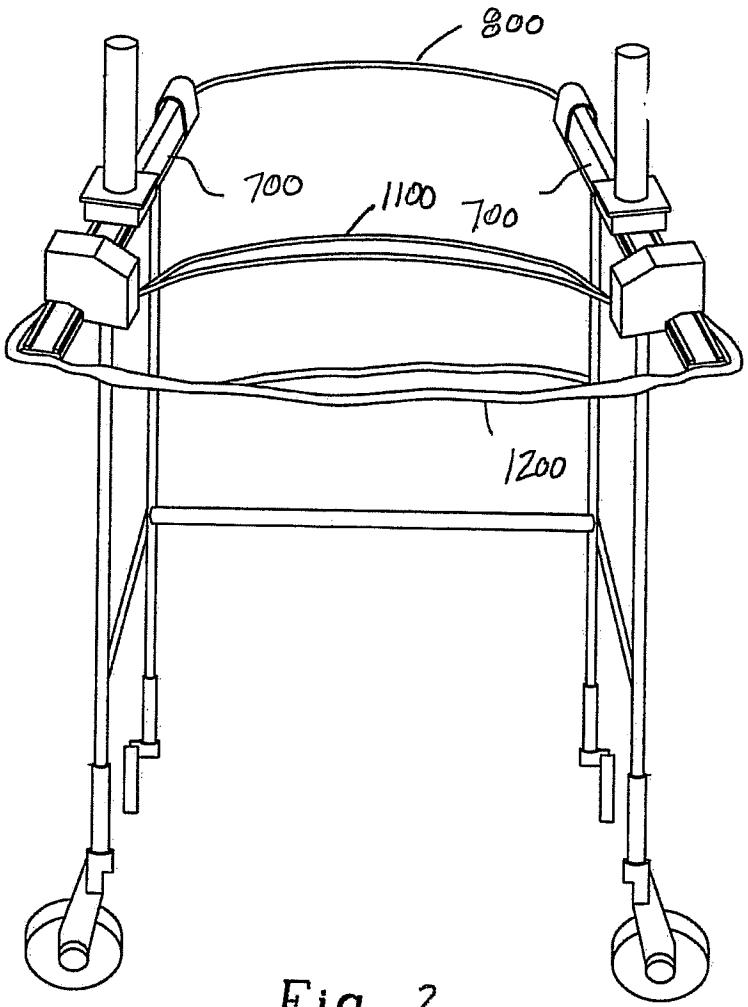
FIG. 2 is a rear view of the walker of FIG. 1.

A standard aluminum walker frame has been incorporated in the first embodiment and is shown in FIG. 1 (side view) and FIG. 2 (posterior view). The walker includes two side frames 100 (110 front, 120 rear) connected anteriorly with bars 200, creating a 3-sided walker. Each side frame 110, 120 has two legs, one anteriorly 110 and the other posteriorly 120 disposed or positioned. The height of the walker can be adjusted (for example, a conventional snap pin is located at the distal end of the walker leg and the snap pin inserts into one of several spaced holes in the fitting which attaches to the walker leg). Interchangeable fittings 300 typically have at their terminus standard wheels, swivel/caster wheels, glides, or rubber tips. Standard wheels 330 are shown on the front legs of the device in the illustration, and caster wheels 320 are shown in the back. This is the preferred embodiment.

Along the upper surface of each of the side frames, a generally L-shaped member such as a piece of steel 400 is secured to the superior and lateral surfaces of the uppermost horizontal bar of the side frame in order to create a stable flat surface to accept a track 500—shown here as a ceramic-coated aluminum rail, forming a miniature linear guide. A similar length of rail is secured to the flat surface. Motion stops 600 (FIG. 1), perhaps a more compact version of the carriage, with a locking mechanism, are positioned fore and aft along each of the tracks in order to delineate the excursion range and to prevent derailing of the mobile carriage. Blocks placed adjacent to a carriage serve to immobilize the carriage and attached UE support assembly for use of the device with statically positioned UEs.

Figure 3A:
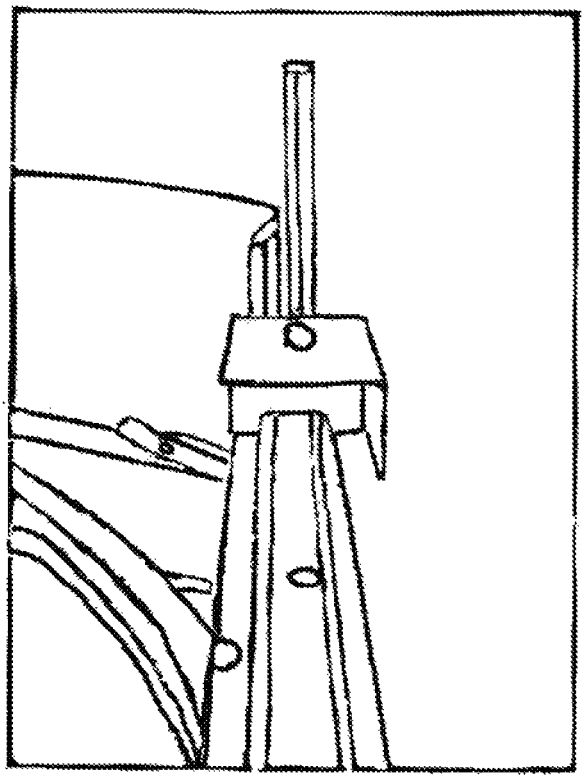
FIG. 3A is a close up view of the mini rail with carriage, positioned atop walker frame with the cable linkage intact.
Figure 3B:
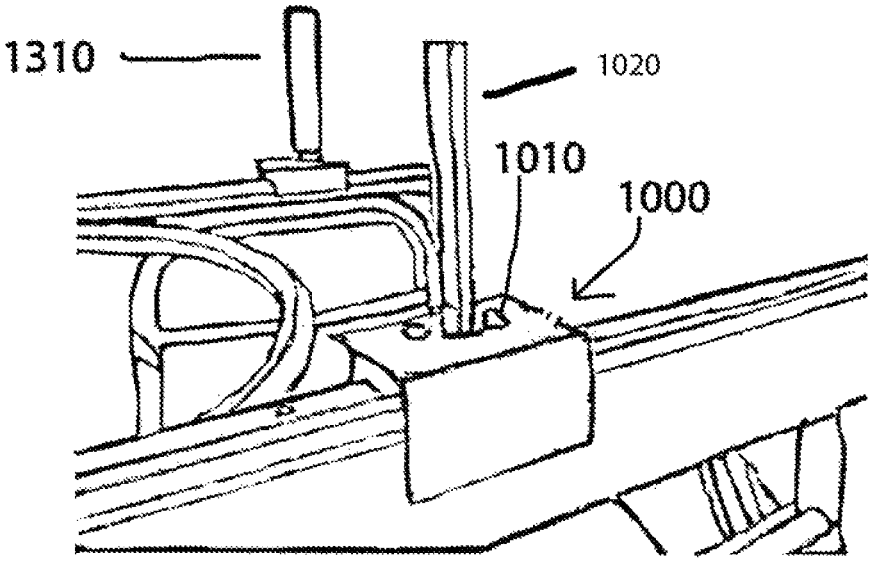
FIG. 3B shows a first embodiment with the linkage disconnected.

A carriage such as a mobile anodized aluminum carriage 700 (FIGS. 2, 3) rests upon each of the tracks and provides the surface to which any of the various upper extremity support surfaces can be attached. An opening or hole 710 is provided (e.g., drilled) longitudinally through the entire length of the carriage, and a set screw inserted on the side of the carriage for securing cable when inserted.

Multiple options exist for creation of a reverse motion or reciprocating motion coupling mechanism. This type of linkage causes symmetrical motion in opposite directions, of two assemblies resting upon parallel (or mirror images—as in curved tracks, tracks/railings, etc.). See FIGS. 13A-13D. These illustrations show linkages between devices on parallel railings, yet one can appreciate that the same mechanisms could be designed for use between devices on parallel side frames/rails of a walker.

The first embodiment includes a cable push-pull linkage. Incorporation of a reverse motion/push pull linkage involves the following. A member such as a curved, firm plastic tube 800 (FIG. 1) is placed between the tracks, and each end of the tube is secured to the track at a location approximately even with the front cross bar of the walker and serves as the guide for the cable. The apex of the curve extends outwardly (e.g., approximately 8 inches) in front of the front bar of the walker, related to the rigidity of the cable, as the cable forms an arc when positioned between the tracks. The ends 810 of this tube serve as the anterior stops, when the linkage is in place, which define how far the carriage can move anteriorly along the rail. Posterior motion stops are not needed as the extent of movement in this direction is restricted by the nature of the cable connection, except for purposes of delimiting the fore-aft excursion distances of each of the two carriages. Restriction of range of UE movement may be desirable for various reasons. A length of cable 900 (such as ¼" steel cable) is inserted, through the appropriately sized hole drilled longitudinally through one carriage, the cable guide (plastic sheath) and through the longitudinal hole drilled in the second carriage. With the carriages placed at the desired location along the tracks, the set screw on the lateral aspect of each carriage is tightened in order to secure the cable in place. The cable is sufficiently rigid such that mobilization of one side is capable of pushing and pulling the other side.

Removal of the cable or disconnecting the carriages/support assemblies from the cable, would enable each of the two support assemblies to function independently. See FIG. 3B. Either or both support assemblies can be caused to move as a user desires or is able, or can be statically positioned. The support assemblies can be interconnected for purposes of related movement, or disconnected to allow independent movement, or statically mounted.

In the first embodiment, support surfaces are attached to the carriage as follows. An L-shaped adapter, for example a piece of steel 1000 (FIG. 3), is placed on top of the carriage and is secured with fasteners such as screws 1010 into the existing holes in the carriage. A fastener is secured (such as a steel bolt 1020 welded in a vertical position) onto the top of the steel plate. This bolt 1020 accepts a hollow cylindrical padded grip 1310 (FIGS. 1, 2), creating a vertically-oriented gripping surface.

Figure 4A:
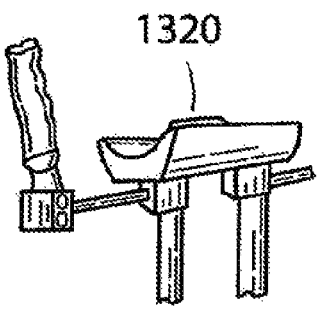
FIGS. 4A-4C illustrate support surface options for attachment to a carriage of the first embodiment including a forearm trough, horizontal grip, and angled grip.
Figure 4B:
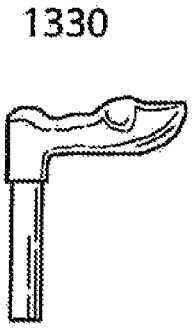
Figure 4C:
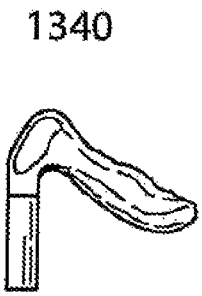

The bolt 1020 or other stable vertical piece could also accept a hollow tube to which is attached a horizontal or angled grip 1330, 1340 (shown in FIGS. 4B and 4C). For attaching a forearm support 1320 (FIG. 4A), two carriages are placed on one mini rail, connected by the cable inserted through both carriages and secured with fasteners such as set screws, with desired separation between the carriages. An adapter is secured to the top of the carriages, for attachment of the forearm support assembly with hollow tubes on the undersurface to accept the upright metal pins on the adapters. Other adapters could be constructed for use, e.g., for attachment of various forearm assemblies and grip handle assemblies. FIGS. 9A-9L are representative of different grip handles that could be used, although one skilled in the art will appreciate that these grip handle assemblies are exemplary only and still other grip handle assemblies or combinations of forearm assemblies and grip handle assemblies can be used without departing from the scope and intent of the present disclosure.

A torso bar 1100 shown here as a curved aluminum tube member (FIGS. 1, 2, 3) is securely positioned between the side frames, with each end of the torso bar attaching to the surface supporting the track. Fore/aft positioning could be adjusted via snap pins, with the ends secured in a support member or aluminum tubing secured to underside of steel support surface upon which the track rests. An adjustable strap 1200 (FIG. 2) (such as a nylon webbing or other similar flexible strap) is fit with a buckle 1210 (FIG. 1), and attached to each of the two ends of the curved bar member.

The proper support surface for each of the two sides is selected and attached to each carriage. Note that any combination of grip handles and forearm support assemblies can be incorporated depending on a user's needs. A height of the forearm support can be adjusted as needed. Likewise, fore-aft position of the support surfaces along the rail are adjusted for optimal fit and function as described above. The height of the walker is adjusted via adjusting the snap pin location in the telescoping members at ends of all four legs of the walker.

Standard or caster wheels are selected for the front and rear legs. Legs without wheels can be introduced to the rear. Standard wheels in the front and caster wheels in the rear is the preferred combination and results in a device which more readily travels along a straight path. Turns are performed by turning the rear of the device opposite the direction of the turn. When UE supports are statically positioned, swivel wheels in the front and standard wheels in the rear could variably be incorporated. Caster wheels with locking mechanisms could be incorporated on all four legs which would enable altering wheel functionality as desired.

Figure 5A:
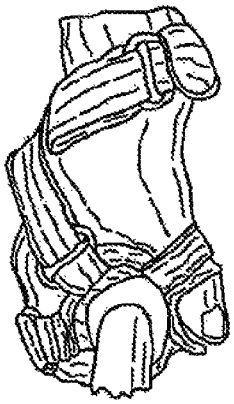
FIGS. 5A and 5B illustrate wrist and hand orthoses securing a distal extremity of a user to a grip handle support assembly and to grip a handle component of a forearm support assembly.
Figure 5B:
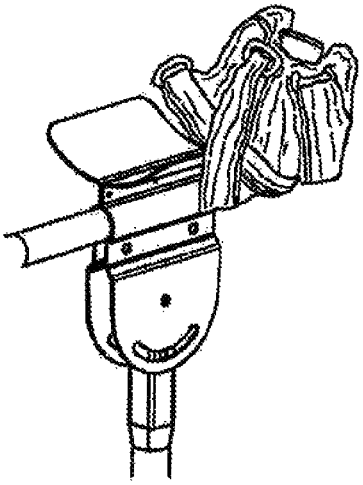

Orthoses can be incorporated as needed to secure the user's wrist and hand to the grip support or to the grip handle component of the forearm support assembly. This would be desirable for users with diminished UE function. FIGS. 5A and 5B illustrate orthoses securing the hand to the grip handle and to a handle portion of a forearm support assembly, respectively. This improves contact and hence device control when gripping function is diminished. When vertical grips (as shown in this embodiment) are used, one might choose to adjust the height of the walker such that the elbow is flexed 90 degrees for purposes of minimizing UE weight bearing, for training in a more efficient walking pattern with flexed elbows.

The torso bar 1100 is adjustably positioned such that when the anterior aspect of the user's torso contacts the torso bar, the feet of the user are positioned for optimal balance and function. Vertical adjustment of the torso bar is not possible in this embodiment yet this would be desirable. The belt strap length is adjusted for secure positioning of the body of the user relative to the torso bar 1100. The torso bar (with belt) serves to attenuate any forces related to arm movement of the user. Advancement of the walker is preferentially caused as a result of contact of the user with the torso bar as opposed to being managed by the UE. The torso bar also serves as a tool for consistent maintenance of optimal body positioning relative to the device.

It is contemplated that engaging the brakes could brake the mobile UE supports along the upper rail and/or actuate the wheels, depending on functionality desired.

The cable linkage can be connected to each of the two mobile assemblies or disconnected. When connected, equal and opposite motion of mobile assemblies results when one or both UEs moves. Disconnection enables one or both assemblies to reciprocate independently of the other, each upon its rail. Early active movement on an involved UE is allowed while the opposite UE moves in reciprocating fashion. Incorporation of an external power source to the mechanical linkage would potentiate repetitive, out of phase movement. Adjustment of frequency of movement could be done to effect changes in stepping cadence. Mechanization of the linkage would provide multiple additional training benefits including symmetrical repetitive motion, velocity adjustment (which in turn affects stepping frequency), enabling the user to focus on LE stepping, reduction in UE fatigue for longer duration training, and setting training session duration. Repetitive reciprocating motion can be accomplished with the linkage disconnected as follows: support assemblies positioned at opposite ends, and each side independently powered. Variably, one side could be externally powered for movement assistance in the case of asymmetric UE functioning.

One or both assemblies can be statically positioned. This may be desirable when walking shorter distances. It may be desirable when training or use of the device necessitates focus on lower body stepping. The embodiment incorporating statically positioned UE supports may be used as a screening tool for adequate lower body function to use the selected wheeled device, as related to the function of the torso bar discussed above. The torso bar can be left in place or removed in order to manage the device with the UEs if desired.

Turning the device with mobile UE supports (with the cable linkage intact or removed) is facilitated as follows. Arm support is moved in the rearward direction on the side the user is turning toward, and arm support is moved in the forward direction on the opposite side. With standard wheels in front and swivel wheels in the rear, the user sidesteps in the direction opposite the direction of the turn, thereby turning the rear end of the device opposite the direction of the turn instead of turning the front end in the direction of the turn when swivel wheels are on the front. The preferred wheel embodiment provides for a safety mechanism when turning: excessively distancing oneself from device moving forward and concurrently turning is often hazardous and is not possible.

Figure 6:
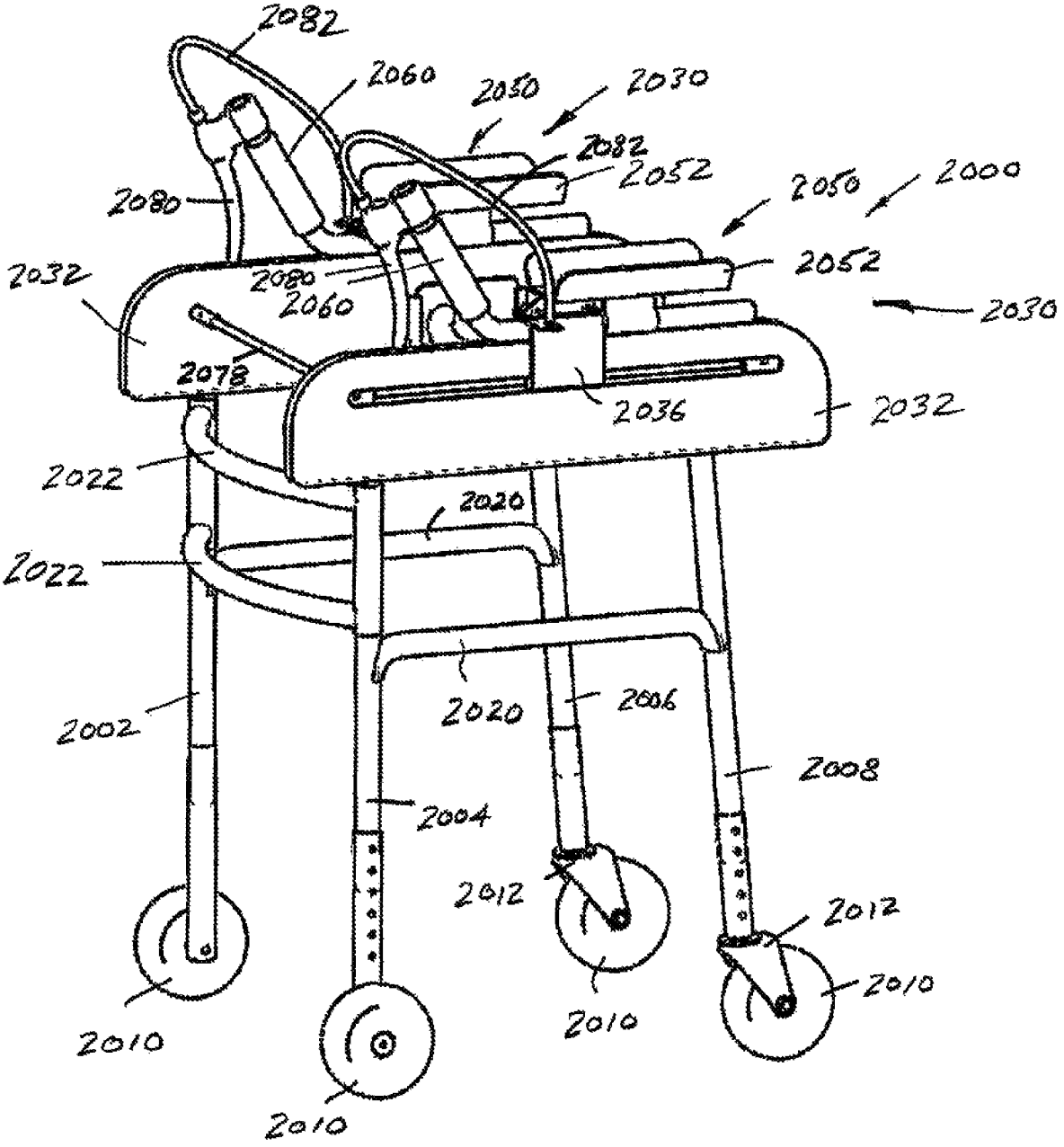
FIG. 6 is a perspective view of the second embodiment of a wheeled walker including mobile UE supports and variation of a belt and pulley reverse motion linkage, and two forearm support assemblies.

FIGS. 6-10 illustrate the second embodiment of the reciprocating arm movement wheeled walker which incorporates a standard walker frame and a preferred type of timing belt/pulley linkage to create reciprocating UE motion. In FIG. 6, a wheeled walker 2000 includes first, second, third, and fourth legs 2002 2004, 2006, 2008. Each of the legs 2002-2008 includes a wheel 2010 at a lower end. In the illustrated embodiment of FIG. 6, the rear wheels 2010 are caster mounted at 2012 for rotation about a vertical axis as is conventionally known in the art. Further, each of the legs 2002-2008 may be height adjustable. Again, details of the height adjustability are well known in the art, although one manner of providing adjustment is to include concentric tubes that include a snap pin received through one of a series of axially spaced openings. The snap pin is mounted to one of the tubes and includes a head or button portion that protrudes through one of the axially spaced openings to define the position (and thus the height) of the concentric tubes relative to one another. Likewise, description of this preferred height adjustment mechanism does not preclude use of other height adjustment mechanisms to accomplish the desired raising or lowering of the upper portion of the walker relative to lower portion.

Side braces 2020 extend between respective legs on each side of the wheeled walker 2000. For example, one of the side braces 2020 interconnects the front right leg 2002 with the rear right leg 2006. Likewise, the other side brace 2020 interconnects the front left leg 2004 with the rear left leg 2008. Moreover, one or more front braces 2022 may be provided between the front legs 2002, 2004.

Figure 7:
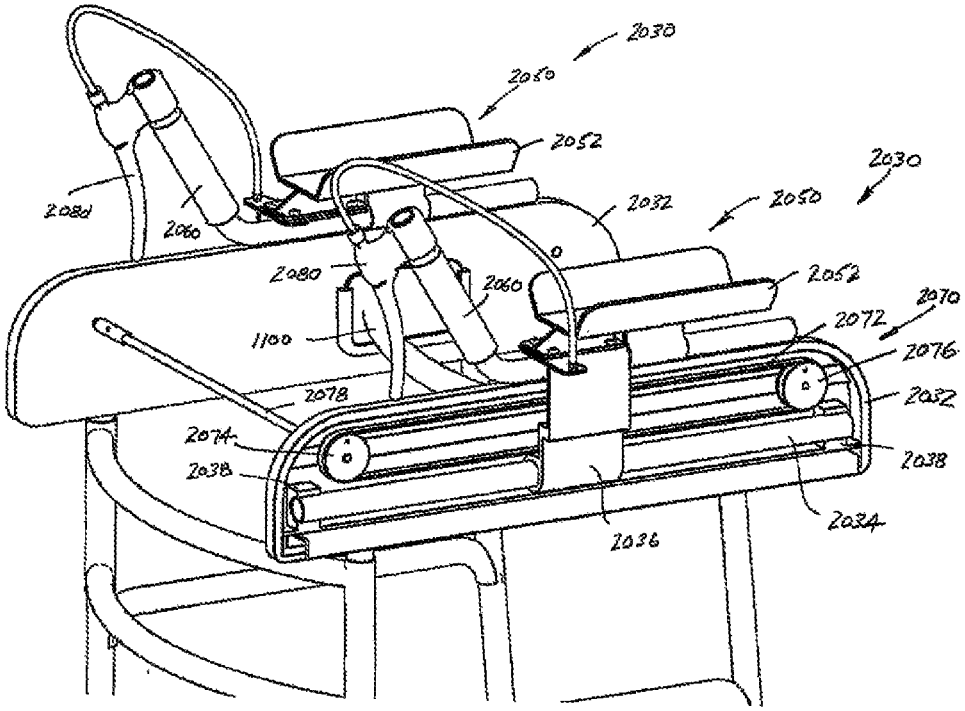
FIG. 7 is an enlarged perspective view of the walker of FIG. 6 with selected portions of the housing removed for ease of illustration.
Figure 8:
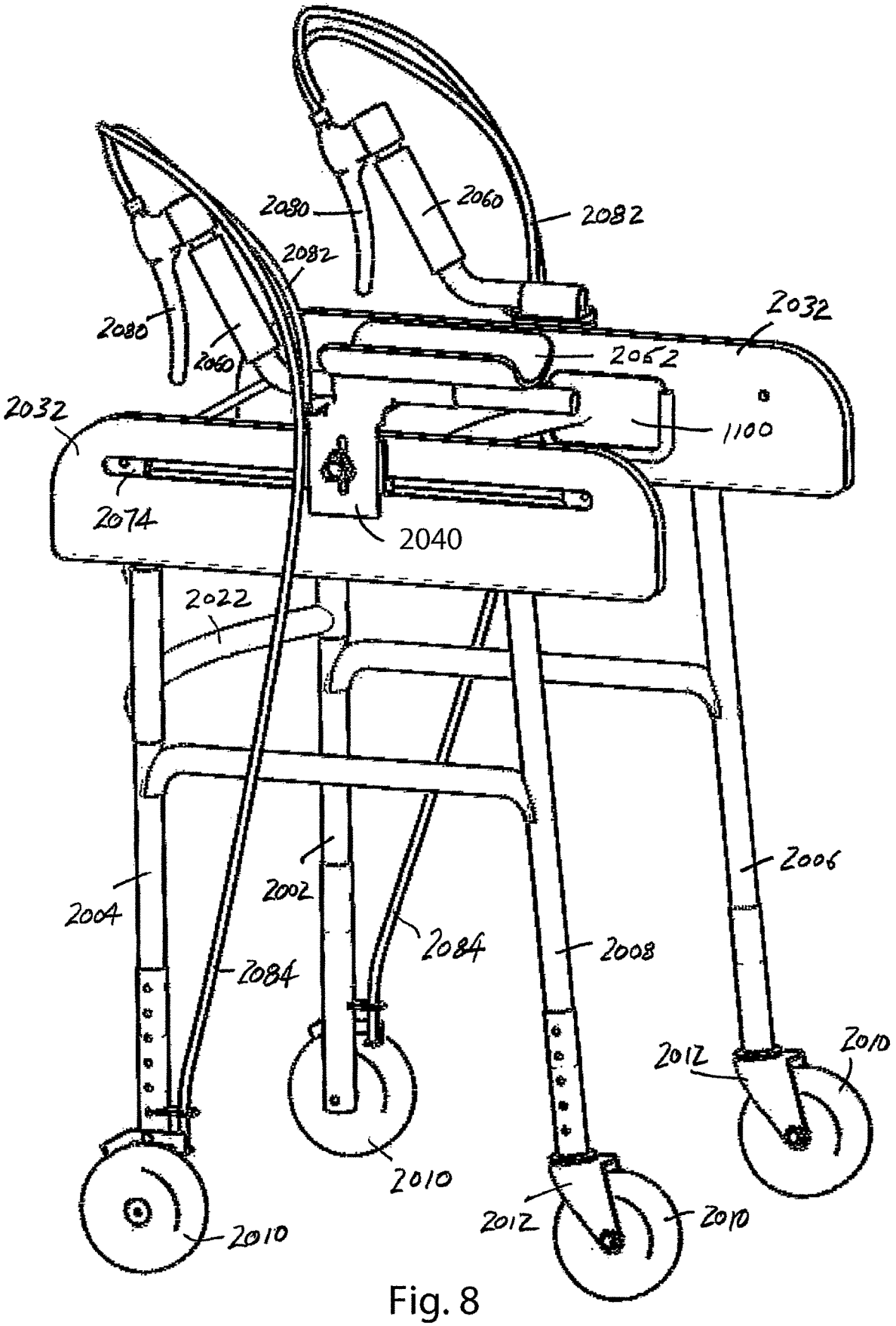
FIGS. 8, 9, and 10A-10C are perspective views of the second embodiment illustrating support surface combinations of a forearm support and grip handle support (FIG. 8), grip handle supports (FIG. 9), and forearm supports (FIG. 10A), and end range positioning of forearm supports in FIGS. 10B and 10C.
Figure 9:
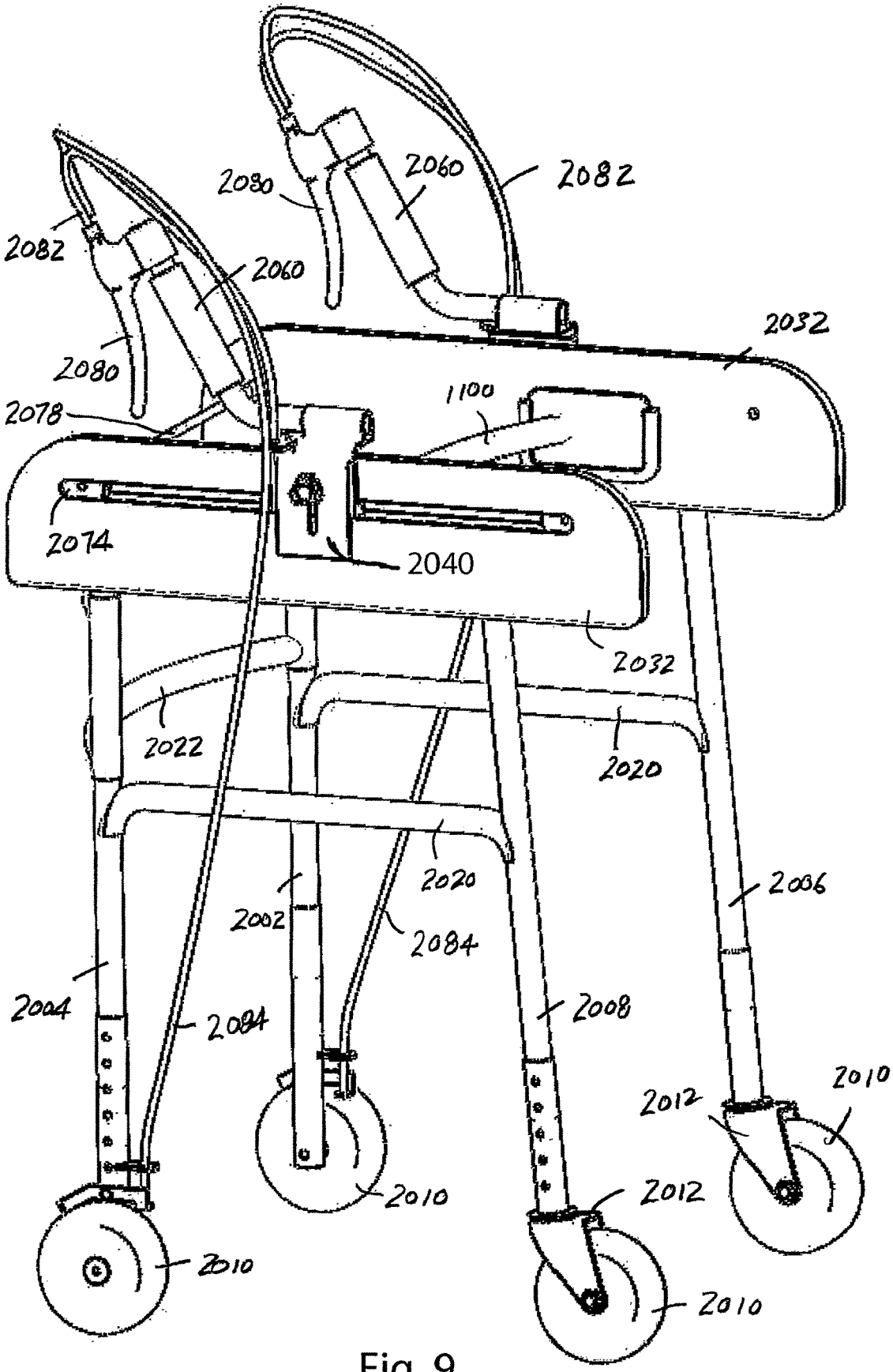
Figure 10A:
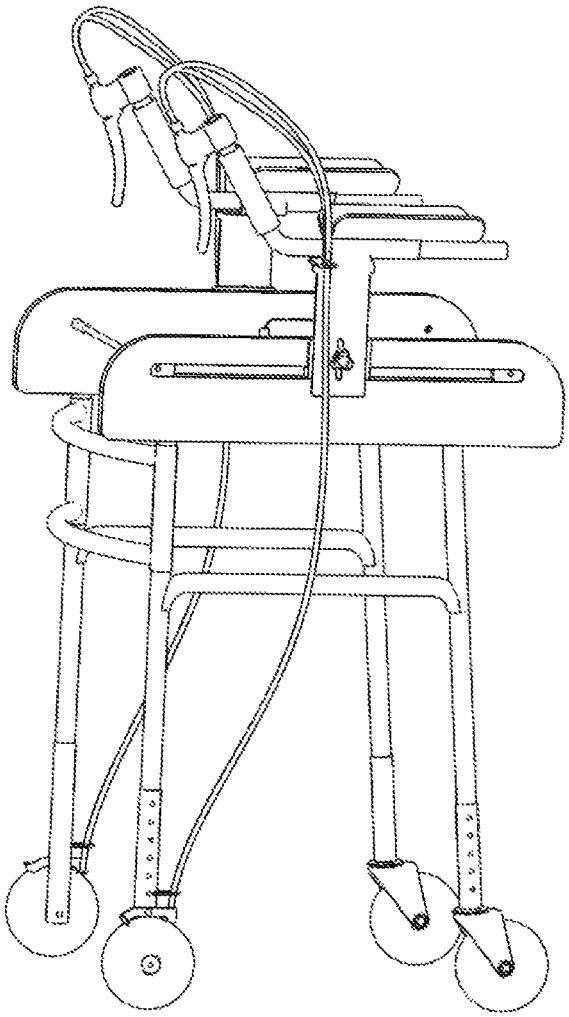
Figure 10B:
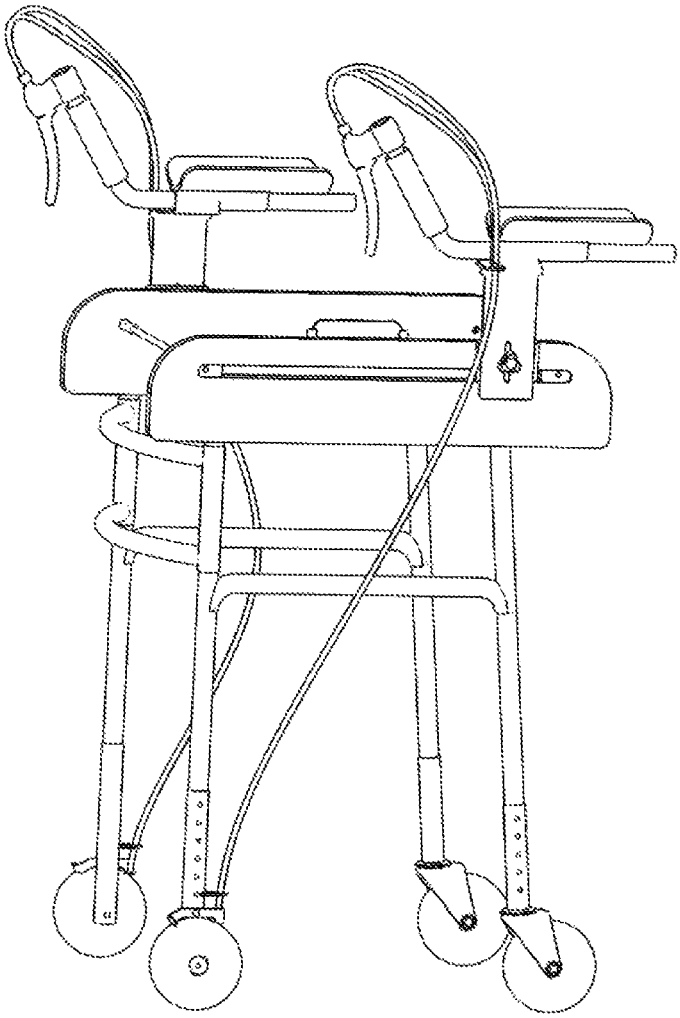
Figure 10C:
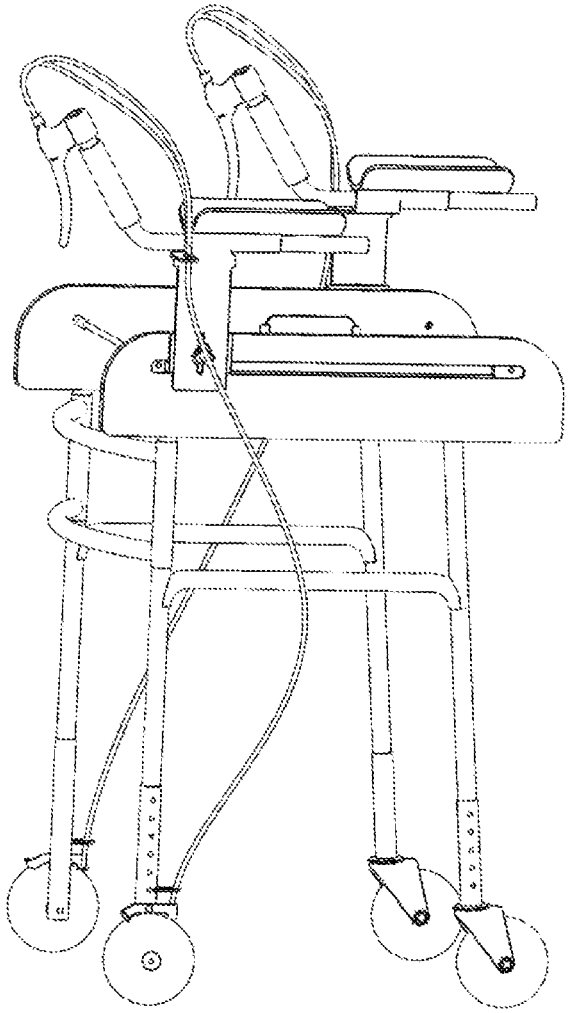

The ability to support an upper extremity or upper extremities of a user (not shown) having various needs are particularly illustrated in FIGS. 6-10. First and second support assemblies or carriages 2030 are shown in FIGS. 6 and 7. Each of the support assemblies 2030 is mounted for selective sliding movement relative to a respective side of the wheeled walker 2000. Variably, one or both may be selectively fixed relative to a respective side of the walker to achieve static UE positioning when this is desirable. For ease of understanding and purposes of brevity, description of the structure and function of one support assembly 2030 is deemed applicable to the other forearm support assembly unless specifically noted otherwise. In a preferred arrangement, the support assembly 2030 includes a housing 2032 that extends along one side of the wheeled walker 2000. The housing 2032 is securely mounted to upper regions of the front and rear legs (2002, 2006 or 2004, 2008) on one side. In the preferred arrangement, the housing 2032 at least partially encloses a rail 2034 that extends horizontally along one side. The rail 2034 is shown as a tubular rail, although the rail could also adopt other configurations. Actuating arm 2036 is received on the rail and movement thereof actuates movement of pulleys 2074, 2076. In FIGS. 8-10, the mounting member is attached to the 'actuating arm', for attachment of trough and grip handle. Mounting member 2036 is slidably received over the rail 2034 and is capable of linear movement relative to the rail both forwardly and rearwardly. Support members 2038 that receive opposite ends of the rail 2034 also serve as stop members to limit the longitudinal movement of the mounting member 2036 on the rail. Secured to the mounting member 2036 is a support member 2050. As evident in FIGS. 6-10, the support member 2050 may adopt a wide variety of styles, and may include forearm support assemblies 2052 with grip handles 2060 two of which are shown in FIGS. 6, 7, 10A-C. One forearm support 2052 and one grip handle support 2060 are included in the embodiment of FIG. 8; and two grip handle supports 2060 are used in the embodiment of FIG. 9. In FIGS. 8, 9, 10, the mounting mechanism is different than the mounting mechanism of FIGS. 6-7; however, one of two varieties of height-adjustable mounting member 2040 is attached to the mounting member or actuating arm 2036. One variety secures only the grip handle support or tube, while another version secures this tube as well as the forearm support or trough. A handle grip 2060 is provided on each mounting member 2036 or 2040. The handle grip 2060 is shown angularly mounted relative to horizontal (e.g. 60° to 75° from horizontal) and follows for neutral wrist positioning when gripping the handle when a forearm is received, for example, in a forearm support 2052. Rotation of the tube enables pronation or supination of the forearm for fit and functional considerations. When gripping handle without forearm support is desired, one can conceive of any of several different types of grip handle arrangements, such as more vertically or horizontally positioned. A grip handle with ball head attachment could be integrated, enabling circumductory wrist positioning. The mounting member 2040 in the version shown in FIGS. 10A-10C has greater height adjustment capabilities than the mounting member version 2040 illustrated in FIGS. 8-9.

As described above, the carriages or support assemblies 2030 are mounted for sliding movement relative to a respective side, and also fore and aft relative to one another, i.e., one side advances forward while the other moves rearwardly, and vice versa. This coordinated action between the support assemblies 2030 employs a mechanical connection or link 2070 and when assembled together (connected), is referred to herein as a reverse motion linkage. The reverse motion linkage serves to move one carriage/support assembly in the forward direction at the same velocity and distance as the opposite carriage/support assembly moves in the opposite direction.

In the embodiments of FIGS. 6-10, and as particularly illustrated in FIG. 7, each housing 2032 encloses one form of a mechanical connection 2070 specifically a belt and pulley assembly that includes a drive belt 2072 that forms a continuous loop about first (front) and second (rear) pulleys 2074, 2076. The pulleys 2074, 2076 are axially spaced apart relative to one another and each rotate about a horizontal axis. The belt and pulley assembly 2070 is located adjacent the elongated rail 2034 within the housing 2032. Moreover, each of the front pulleys 2074 is interconnected by a shaft 2078 to coordinate the movement between the right and left sides. Specifically, rotation of the front pulleys 2074 are interconnected via a geared mechanism so that rotation of the belt in one direction on one side is opposite the rotational direction of the belt on the other side, and consequently as one carriage 2030 on one side of the wheeled walker moves forwardly, the carriage on the other side of the wheeled walker moves rearwardly. Moreover, movement of one carriage in the forward direction is at the same velocity over the same distance as the other carriage moves rearwardly.

A handbrake 2080 is also conveniently positioned relative to the handle grip 2060. Actuating the handbrake 2080 as shown in FIGS. 6 and 7 is intended to stop movement of the carriages along the rail as represented by cable 2082. As illustrated in FIGS. 8-10, a second cable 2084 is shown so that the handbrake 2080 is connected to one or both front wheels 2010 for braking thereof. Users with decreased functionality of one UE would find this arrangement desirable. It is also contemplated that the handbrake mechanism

2080 could provide for stopping movement of the individual carriages 2030 as well as providing a braking force to the wheels 2010 with a single cable, or with a different braking assembly. It may also be desirable to be able to brake the wheels, without concurrently braking movement of carriage along rail. Multiple braking options are possible, in order to achieve the most efficient, functional, safe gait pattern given a user's physical characteristics.

The carriages are positioned symmetrically, with fore-aft positioning such that when the support surface is engaged by the user, the shoulder is in a neutral position (i.e., even with midline of body when viewed laterally). As related to variable fore-aft contact location of the extremity with the support surface, when comparing grip support to forearm trough support, bilateral grip handle supports will be symmetrically placed slightly more forward along the rails, and bilateral forearm supports will be symmetrically placed farther back along the rails. This is due to the ability to vary the UE contact point with the rail depending on the elbow position of a particular user. One grip handle and one forearm support may be desirable, as well, for various clinical reasons. With the current embodiment with grip supports in place, the carriage can be mobilized anterior relative to the neutral position to a location approximately even with the front horizontal bar of walker (e.g. approximately seven inches anterior to the neutral position) and posterior relative to the neutral position to a location roughly even with the attachment of the torso bar to the side frame (e.g., approximately seven inches posterior to the neutral position), enabling symmetrical arm motion during gait. Of course one skilled in the art will recognize that the noted dimensions are exemplary only and the subject disclosure should not be unduly limited to these dimensions.

The carriages can be connected with the reverse motion linkage or can be unlinked simply by removing the coupling shaft. Removing the coupling shaft or unlinking the carriages from cooperating movement with one another would allow for independent movement of each of the two carriages along each of the two respective rails. As such, the direction of and the extent of glide of each of the two mobile assemblies, is independent of the other.

FIG. 10A illustrates symmetrical (forearm) support assembly positioning, while FIGS. 10B and 10C illustrate support positioning at the end range of movement of the support assembly/carriage.

The carriages allow for very low resistance gliding along the tracks. Variable resistance to glide could be introduced in any of the embodiments. Adding resistance to upper body movement could be desirable for purposes of use of the device for upper body strengthening.

In the second embodiment, the device is unfolded by moving one side frame away from the other side until the joints between the two front legs and the two horizontal front frame members lock into place. The end plates of the torso bar are lowered into the pockets or recesses on the inner surfaces of the housing. The desired wheel type on front and rear wheels is selected for optimal functioning. Standard wheels in the front and casters in the rear are the preferred embodiment. The walker height for a particular user is adjusted for proper fit and function by adjusting the positions of the snap pins in the holes of the leg attachment pieces. The height of the forearm support trough(s) is likewise adjusted if this type of support surface is selected. It is also understood that a grip surface on one side and a forearm support assembly on the other side or two grip handle supports could be used. The desired support surfaces are selected and secured to the device.

The actuating arms (mounting members) are positioned for fit and function for a particular user. Motion of a support surface of, for example, up to 17.5 inches of total travel has been achieved with this embodiment, and again, a greater or lesser amount of travel is contemplated without departing from the scope and intent of the present disclosure. This disclosure accommodates variable introduction of grip supports or forearm supports and the variable neutral positioning associated with each. The coupling shaft is engaged to lock the support surfaces into the desired positions, which may be asymmetrically placed, for example, if both a grip and a forearm support are used. Otherwise, the supports would typically be symmetrically placed. In the mid-position, the same amount of travel fore and aft relative to the midline of the body results. Alternately, placement of the support or carriage more forward results in a greater percentage of the travel in front of the midline, and placement of the support or carriage closer to the rear of the device results in a greater percentage of the travel posterior to the midline of the body. The coupling shaft is left disengaged if independent movement of the arms is desired.

Testing of brake functionality is performed for safety purposes. Brakes can be engaged as needed, for purposes of arresting the movement of the support surface along the rail, and/or for arresting the movement of the device along the ground. When the coupling shaft is in place, braking one side will cause braking of both UE supports. One brake lever can be configured to brake both wheels of the device if this is desired, such as in cases of UE dysfunction unilaterally.

The torso bar could be made to be adjustable for fore-aft and vertical positioning. Adjustability of the torso bar is not specifically shown in this embodiment but it is well within the purview of one skilled in the art to provide an arrangement that permits such adjustment. The user addresses the walker, and with the current embodiment, maintains contact of the abdomen with the torso bar and secures a belt attached to each end of the torso bar, such that constant contact with the device through the torso bar is achieved. The arms of the user are placed on the support surfaces.

It will be recognized that the present disclosure is not limited to the physical structures and functions described herein, but is intended to encompass variations and modifications that are reasonable extensions of these teachings. For example, a glide on track; glide directly on rail; or any other device which stably glides along a track. Alternately, an undersurface of a forearm trough is equipped with rollers, bearings, or any of several other mechanisms to accomplish secure mobility (i.e., relative sliding) along a track.

Figure 11A:
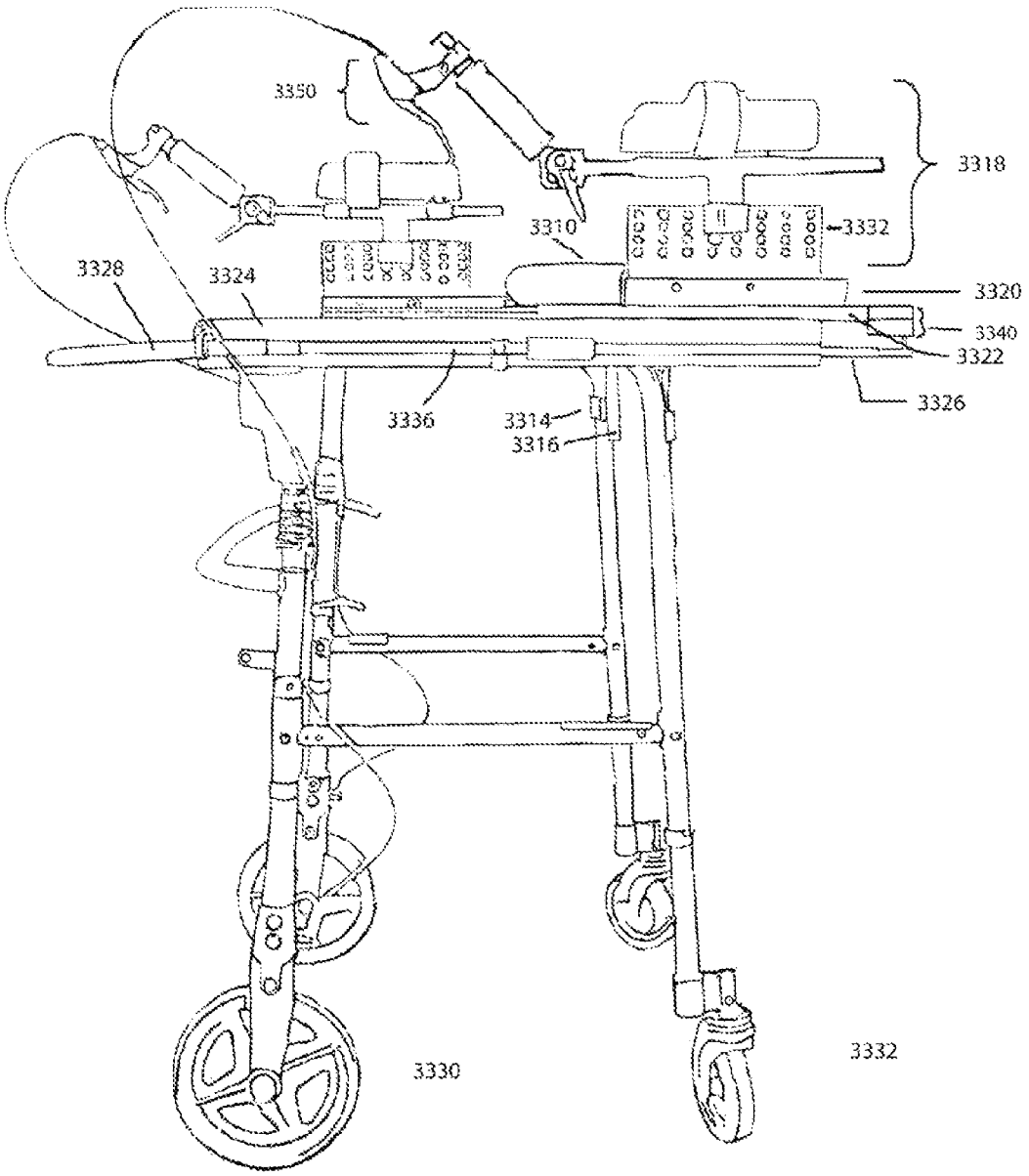
FIGS. 11A and 11B are side and top views of a preferred walker in accordance with the present disclosure.
Figure 11B:
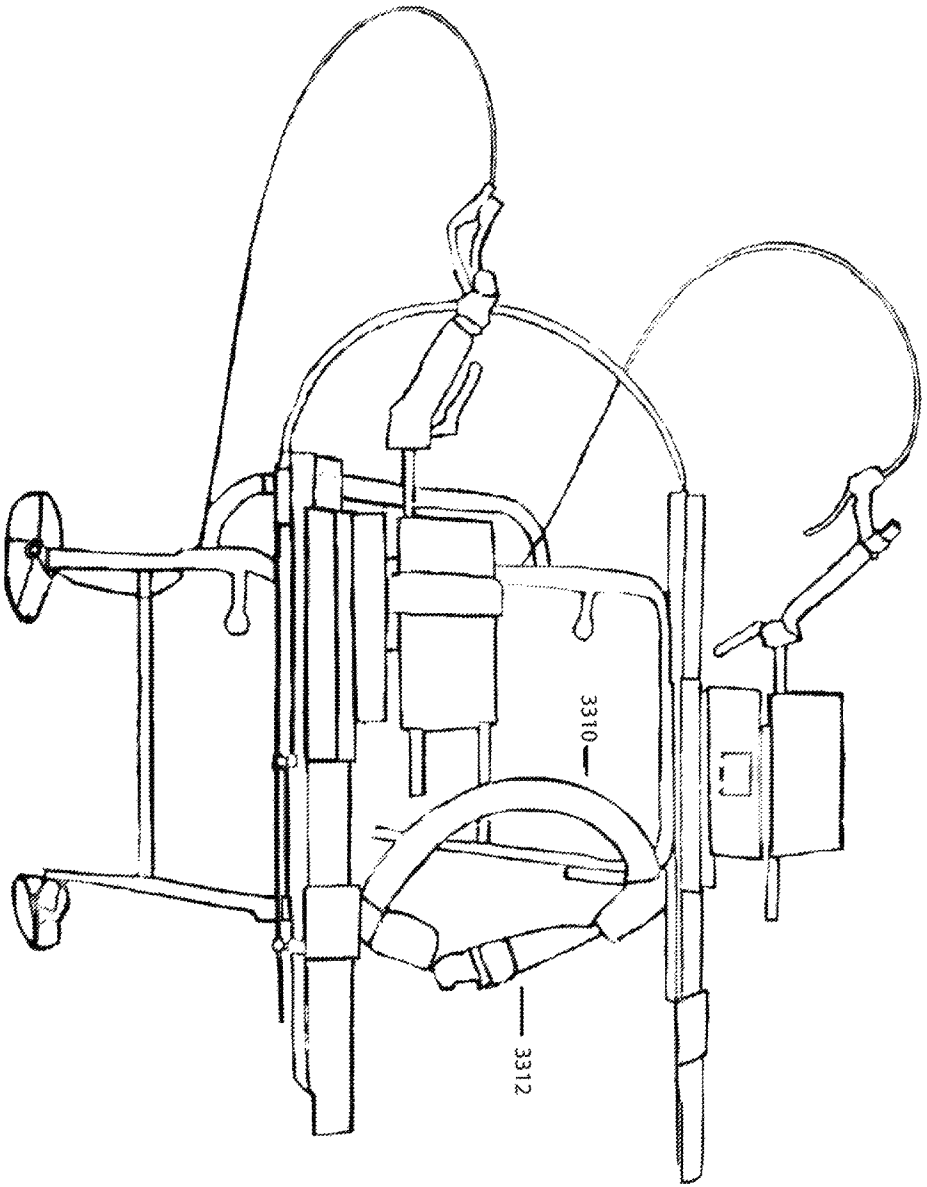

FIGS. 11A and 11B illustrate a third embodiment of the disclosure. An alternate method of achieving mobile assemblies, of connecting a push pull cable linkage, and attaching the support surface assemblies is incorporated. The ends 3316 of torso bar 3310 are positioned vertically and are secured in clamp 3314 which attaches to the rear portion of each side of the frame. Forearm support assemblies 3318 are capable of being adjusted vertically and fore/aft (see adjustment openings in vertically aligned plates 3332) to allow the support platform to be raised and lowered, and to be mounted forwardly and rearwardly as desired. The base of each plate is secured in an aluminum U channel 3320. One or two grip handles can variably be secured to the U channel instead of the forearm assembly. On each side frame, an L-shaped length of steel 3324 is placed upon the top rail. The frame of the drawer slider 3322 is securely mounted on the steel surface. The U channel is securely mounted to the sliding component of the telescoping drawer slide. The ends of a length of ¼ inch diameter steel cable 3326 are secured to a plate 3340 behind each of the two U channels. A length of brass tubing 3336 is secured to the vertical portion of the steel plate. A curved plastic tube 3328 is positioned level with the horizontal steel cable and the two ends are secured to the brass tube. Forward movement of the support assembly mounted on the drawer slide causes the cable to move through the brass tube in a forward direction. Rearward movement of the opposite support assembly occurs on the opposite side. The linkage can be disconnected to enable independent functioning of each of the two UE support assemblies by disconnecting the cable from plate 3340. Brake levers 3350 are mounted on the grip handle (gripping by the user but forearm is not supported) and forearm support assembly grip handles (a gripping surface adjacent to forearm trough on a forearm support assembly) and brakes actuate the front wheels. Caliper brakes can be introduced in this embodiment to enable braking of the mobile assembly along the rail concurrent with wheel braking by incorporating a forked cable.

The torso bar 3310 is positioned so that the user is positioned with feet in the rear half of the walker with the anterior torso contacting the arc-shaped bar (see FIG. 11B). The user is urged into engagement with the torso bar by the adjustable belt or strap 3312. Use of a spring-loaded torso bar or pad connection to frame would provide some limited bodily movement, i.e., some 'play' (e.g., a spring-loaded connection between torso bar and frame would enable some freedom of movement between the user and associated torso bar and the wheeled device).

Wheels are secured to the front legs and casters on the rear. The seat has been removed yet it is understood that this feature would be desirable in many applications. The user would access the seat by removing the torso bar.

Figure 12:
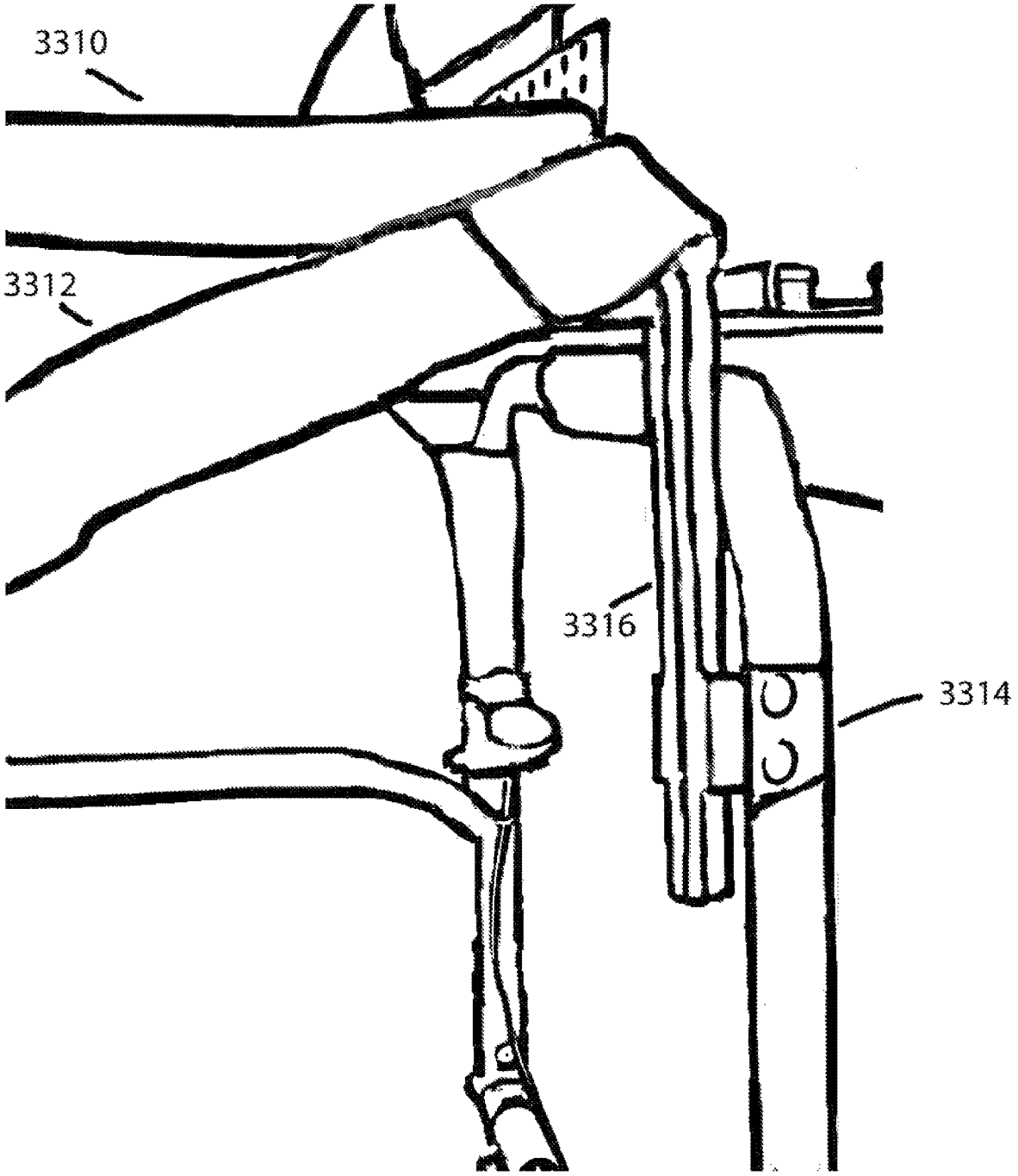
FIG. 12 is detailed posterior view of the right side of the torso bar.

FIG. 12 is a posterior view of the right side of the frame and torso bar 3310 and the adjustable belt 3312. It is also recognized that the torso bar may be selectively raised and lowered (see adjustable fixture 3314 secured to the side frames) and that through use of fasteners such as screws or the like, the vertically extending tubes 3316 extending from the rear portion of the torso bar in place can be selectively raised and lowered.

FIGS. 13A-13D are different designs of reverse motion linkages which are shown on parallel rails which can represent the parallel rails (top portions of side frames) of a walker and hence could variably be integrated into walker design. The linkage assemblies provide for reverse motion of the first and second mobile assemblies (and hence whatever support surface is attached thereto) when secured to parallel rails.

Figure 13A:
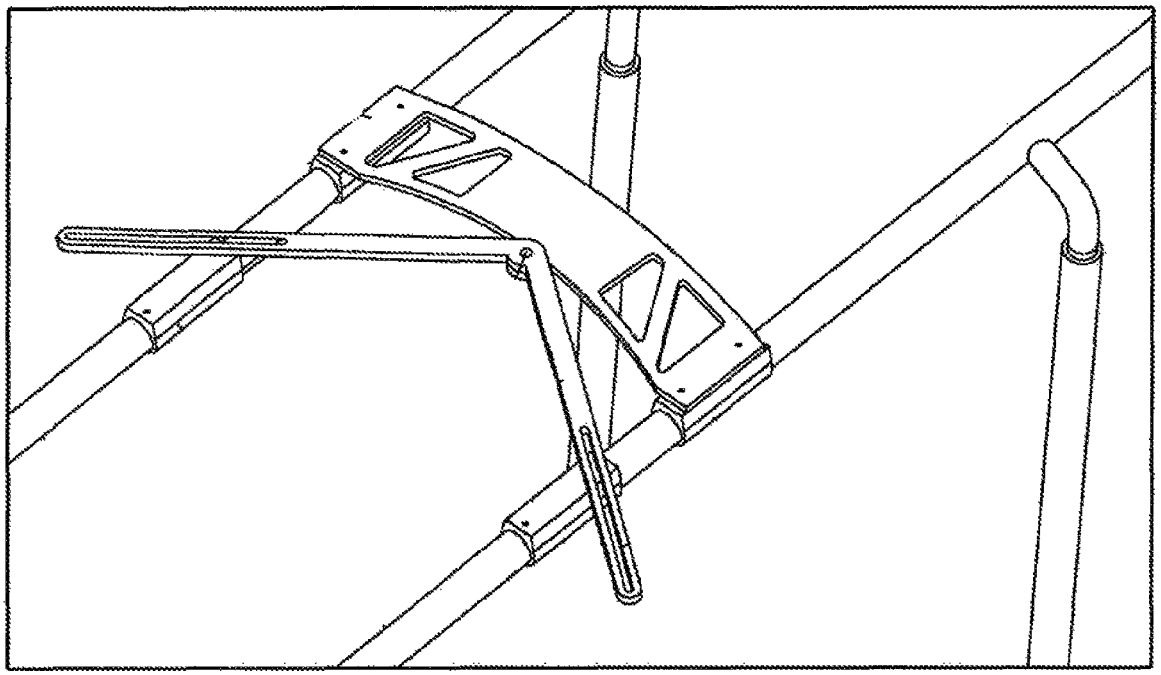
FIGS. 13A-13D are schematic representations of reverse motion linkage designs, depicted on parallel railings, and in particular
Figure 13B:
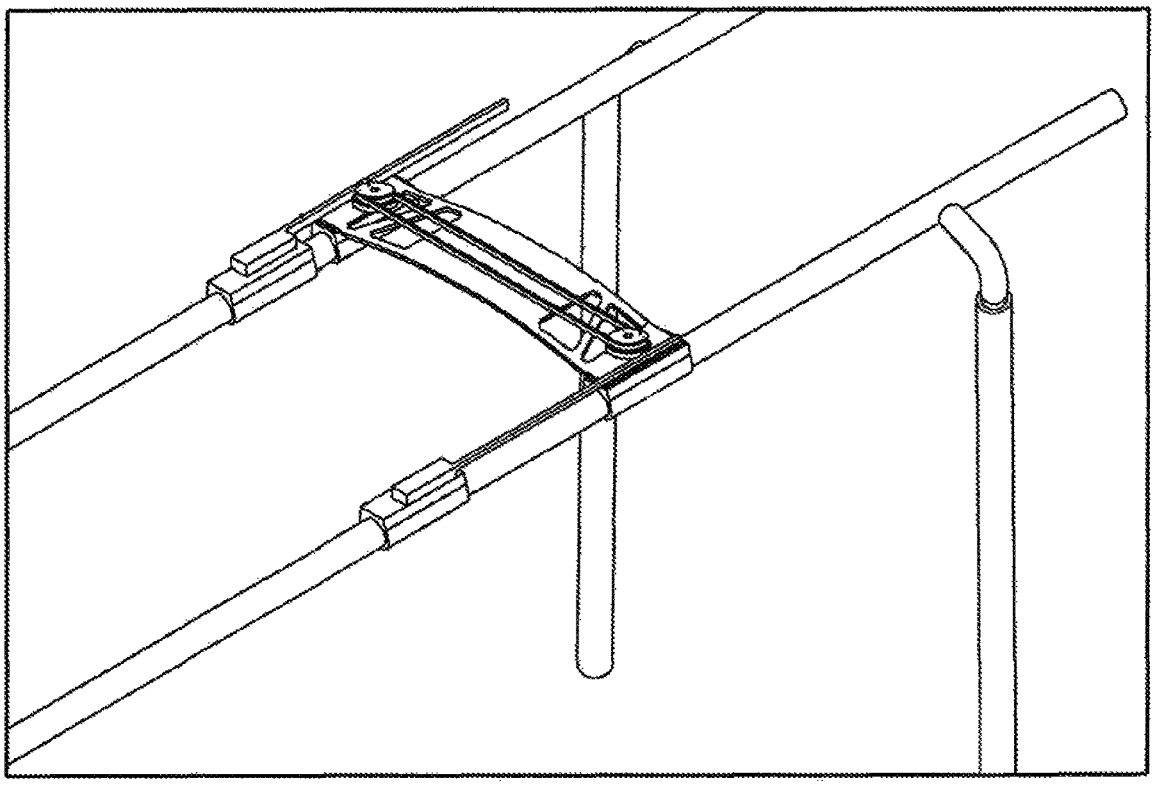
Figure 13C:
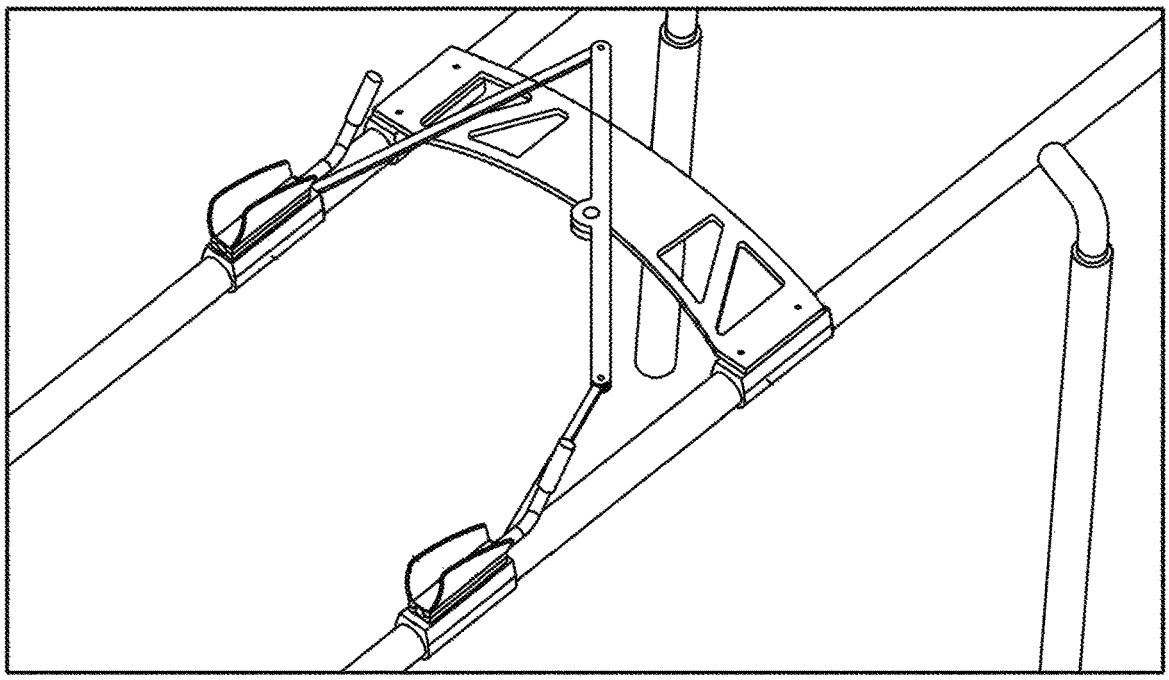
Figure 13D:
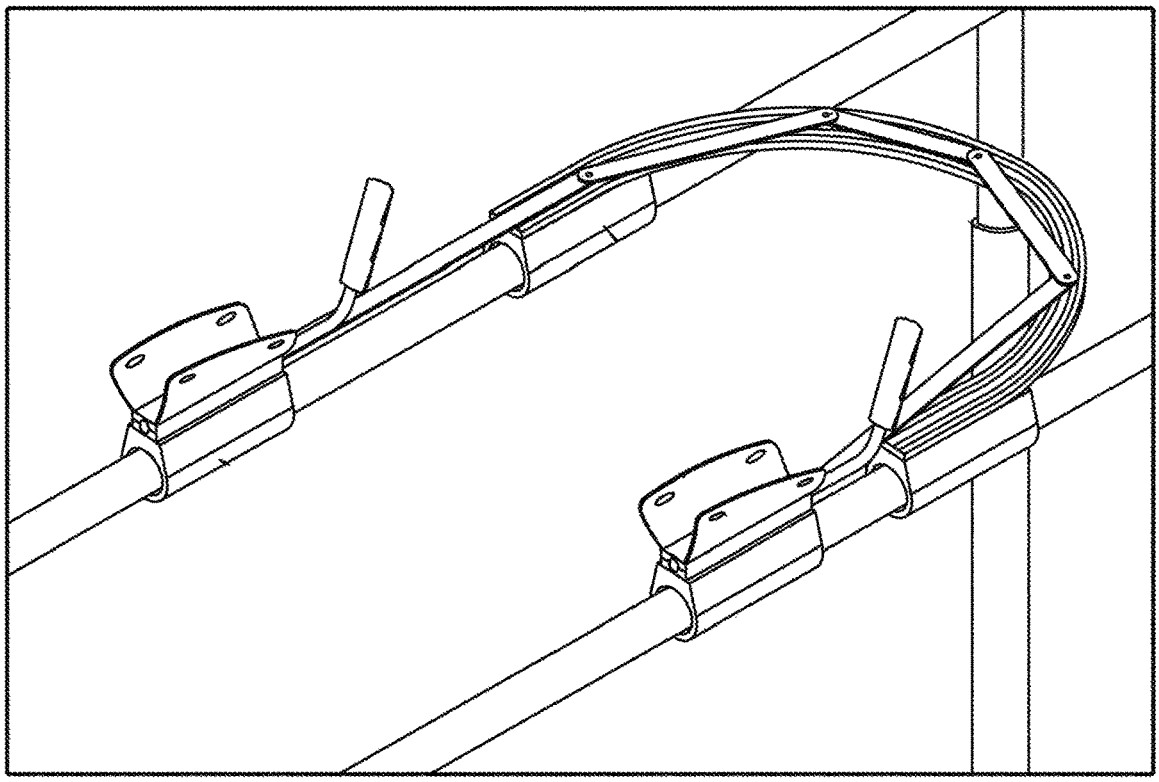

As explained, this linkage can be connected or disconnected, the latter enabling independent movement of each of the two support assemblies. The component which is mobile upon the rail is similar in function to a mobile device presented in FIGS. 15A-C and will be called a rail linkage assembly. It is understood that mobile devices which glide along a track as opposed to directly on the rail such as in embodiments 1 and 3 could also be connected with reverse motion linkages. In FIGS. 13A and 13B, the support surface has not yet been attached to the rail linkage assembly. In FIGS. 13C and 13D, a forearm trough is attached directly to the top surface of the rail linkage assembly, hence creating mobile support assemblies. The spanning members are affixed to the anterior portion of walker frame. In FIG. 13B, the first and second rail linkage assemblies 1360 each move relative to their respective rail, and each move relative to one another via an interconnecting flexible member such as a wire, cable, etc., received around one or more pulleys. Thus, as one of the rail linkage assemblies moves rearwardly, the other rail linkage assembly moves forwardly. In FIG. 13C, a different mechanism is shown. A three bar linkage assembly is shown that includes a central arm pivotally mounted to the cross member. Opposite ends of the central arm are, in turn, pivotally connected to link arms that are connected at their distal end to respective slidable rail linkage assemblies. In FIG. 13D, still another variation of a reverse motion linkage is illustrated. Here, additional links or arms are pivotally connected to one another and to the support portions of the rail linkage assembly. A cable could also attach to the mobile assemblies and travel along the U shaped track. The cross member has a generally U-shape and includes a track or group that receives connection members or pins that join the individual links together, and partially constrain relative movement or orientation as the rail linkage assemblies move to and fro.

Figure 14A:
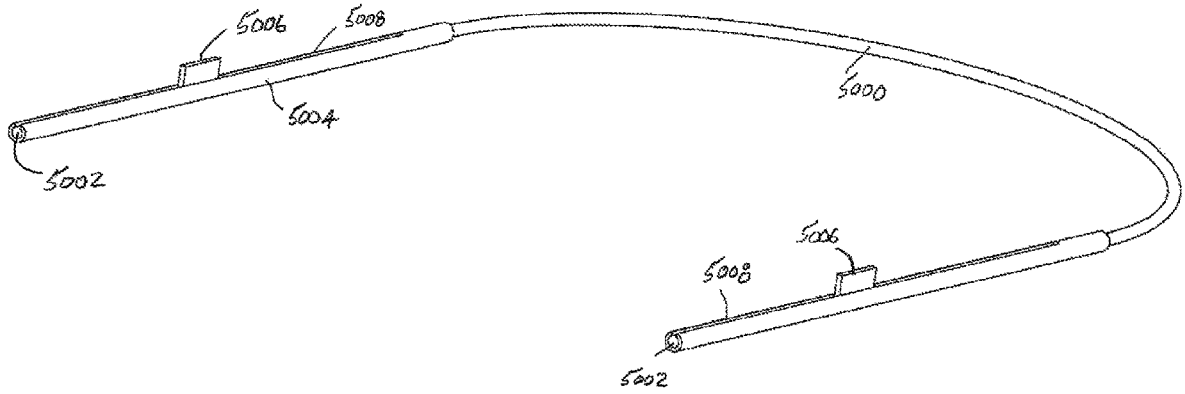
FIGS. 14A-14C show variations of an additional push pull cable design such as could be incorporated in the first or third embodiments.
Figure 14B:
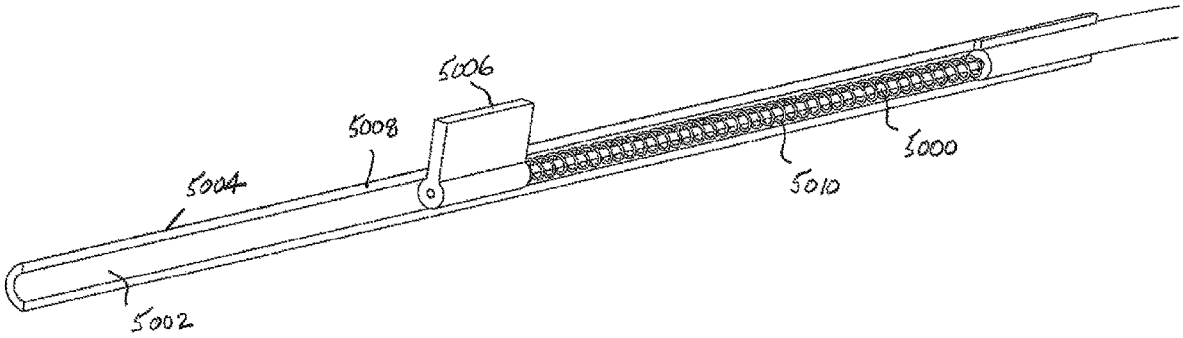
Figure 14C:
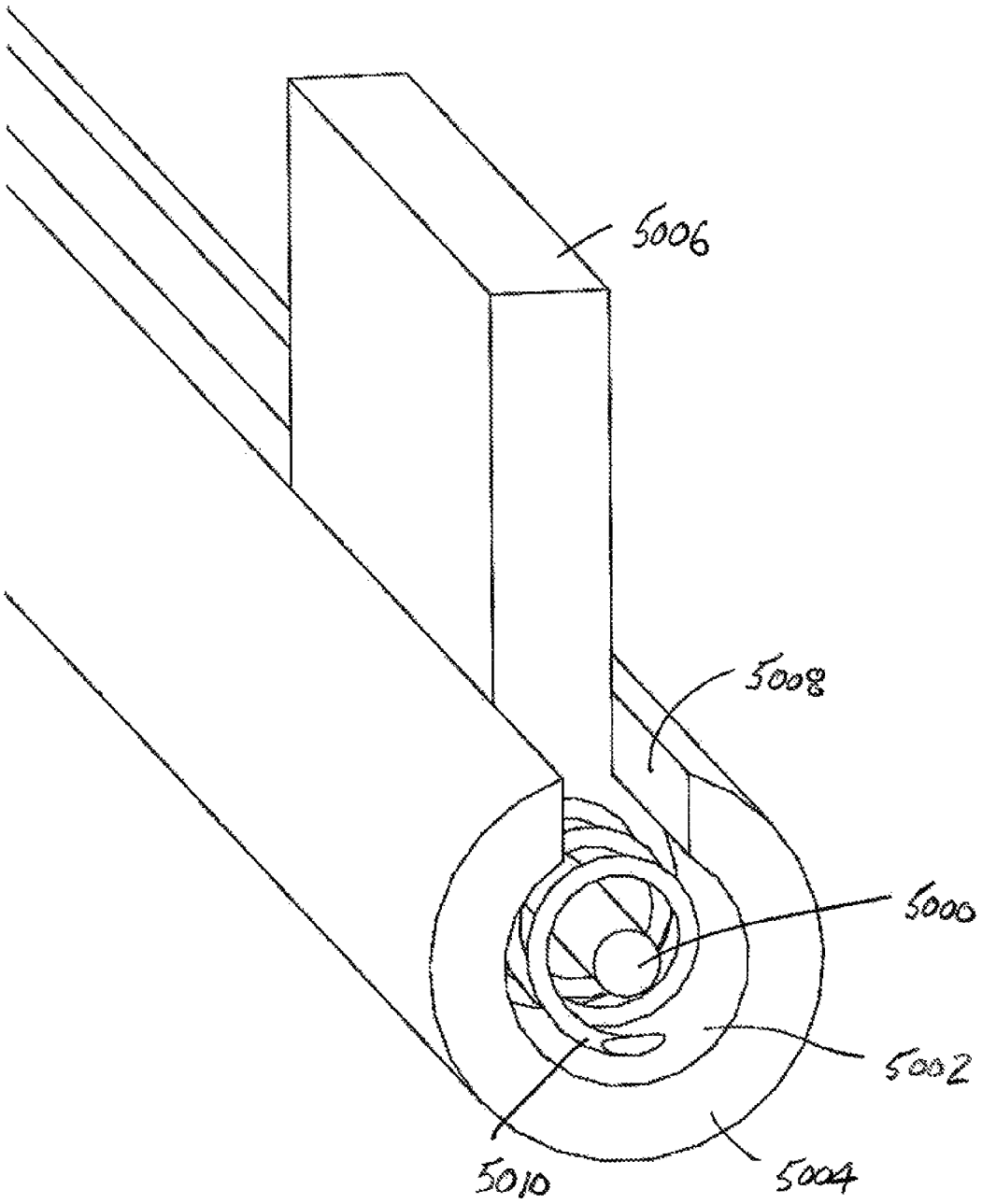

In FIGS. 14A-14C a push pull cable 5000 is provided. Custom made spring 5010 keeps the cable 500 from buckling when the cable is pushed. Other components other than a spring such as a bellows or the like, could be used to prevent the cable from buckling while still permitting the sliding component 5006 to move forwardly and rearwardly in slot 5008 formed in the tube 5004 having a hollow portion with an elongated slot. The support assemblies or carriage assemblies described above in connection with, for example, FIGS. 6-9 would be secured to the component 5006.

Figure 15A:
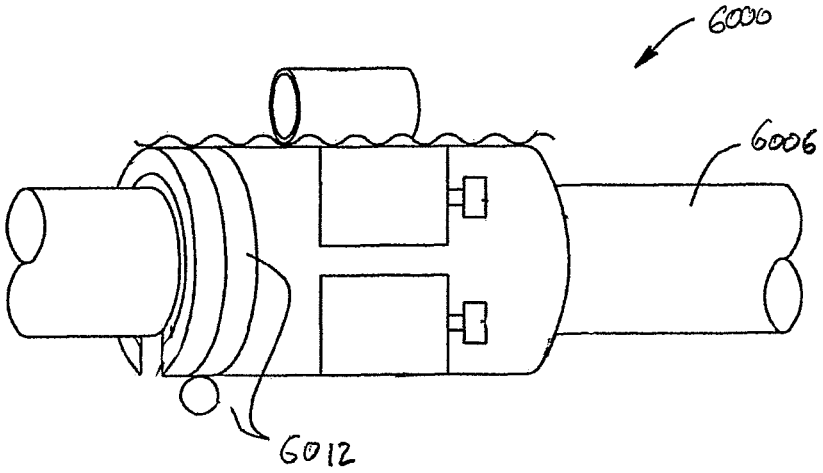
FIGS. 15A-15C show a mobile assembly which would glide along top rail of device, as opposed to a mobile unit which glides upon a rail or track attached to the rail of the device (as in the first, second, and third embodiments) and to which support surfaces and reverse motion linkage could be attached.
Figure 15B:
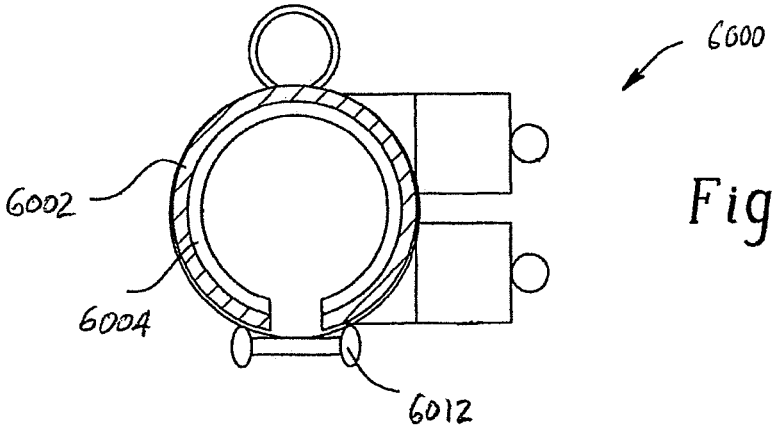

FIGS. 15A-15B are side and cross sectional views of an assembly which can be securely positioned upon a top rail of walker as opposed to an assembly which is mobile upon a track which rests on upper surface of walker frame. The assembly is, for example, a rigid member such as a cylindrical steel (or other metal, polymer, composite) tube of variable thickness lined with a material that facilitates sliding movement relative to the rail/bar on which the assembly is mounted such as a self-lubricating polymer such as ultra-high molecular weight polyethylene (UHMWPE). The polymer is cut to be variable thickness and geometry (and hence cross-sectional shape when viewed following lining the cylinder with the layer of material and examining cross sectional), such that the assembly conforms to the rail onto which the assembly will be attached and along which the assembly will translate. An assembly with a collar fitting rails of variable shape other than round, will not freely rotate about the long axis of the rail; as such, vertical stability of the device will be inherent. The resultant inside profile or diameter of the device is the same as or equal to the outside profile or diameter of the rail onto which the device is attached, in the case of a round railing. The polymer can be backed with an adhesive and hence affixed to the internal surface of the cylindrical tube, or attached in other ways so as to enable exchanging and reusing collars readily. The plastic collar can be simply removed and replaced with an alternate collar, such that the device can be used on an alternate rail if desired. For example, a slit is cut lengthwise along the cylinder and the assembly is hinged to enable opening such that the assembly can be opened and put on a rail and subsequently secured in place. A tube weldment is located on the top (or other surface) of the device and receives and secures the linkage. A fastener 6012 serves to approximate the two separated edges of the cylinder and can be tightened or loosened in order to vary the amount of friction when the device moves relative to or glides along the rail. The fastening device can be of any design/configuration and one or more could be incorporated as needed to achieve friction adjustment of the device. It is also contemplated that instrumentation of the fastening device would be desirable to allow objective measures of resistance to movement hence incorporated. One or two tube clevises are secured via welding or other means to one side of the device and serve as the receptacle for the upright tube which is the attachment mechanism of the various UE support assemblies. Tightening screws serve as one option of a mechanism and method to tighten the tube clevis around the tube. It is also contemplated that the collar and inner lining could be a single component, i.e. the lining integrally formed as a part of the tube such as a reinforced polymer collar that includes a lubricious material (or is inherently lubricious) to facilitate manufacture of the arrangement. Again, the present disclosure is intended to illustrate one preferred embodiment but is not deemed to be limited to only this embodiment.

Figure 15C:
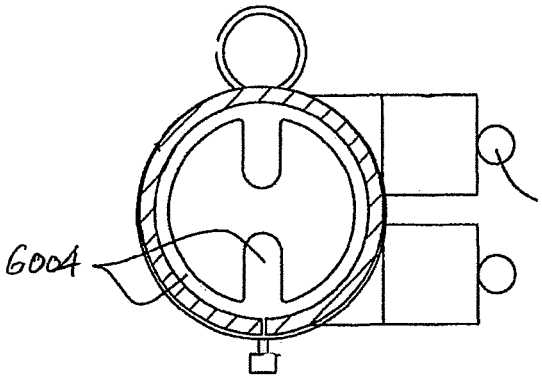

FIG. 15C is a cross sectional view of device with a plastic lining (collar) with two projections which run longitudinally within the device, and which is fabricated to accommodate a railing of alternate shape (i.e. one with longitudinally-running grooves along the superior and inferior aspects). The same device is lined in this example with a specified thickness of plastic, for example, which lines a portion of each hemisphere of the cylinder, and has projections (on the top and bottom in this example) which accommodate a railing with mirror image indentations. As is illustrated here, the device can be split and the two portions hinged secure with the fastening screw(s) which simply secure the abutting edges of the cylinder assembly together as opposed to serving as a progressive tightening mechanism. Functionally, a device which conforms to a noncircular rail such as this would be inherently stable and a linkage serving to provide rotational stability of the device on the railing would likely not be needed. A reverse or reciprocating motion linkage such as those illustrated in FIG. 13A-13D or other, could variably be incorporated and therefore an attachment site (such as a tube weldment shown here) for such is needed.

Figure 16:
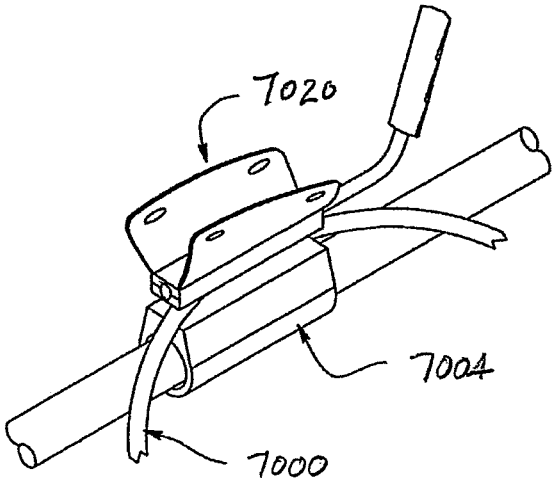
FIG. 16 illustrates a curved (track) which could be integrated instead of straight tracks, and a mobile support assembly.
Figure 17:
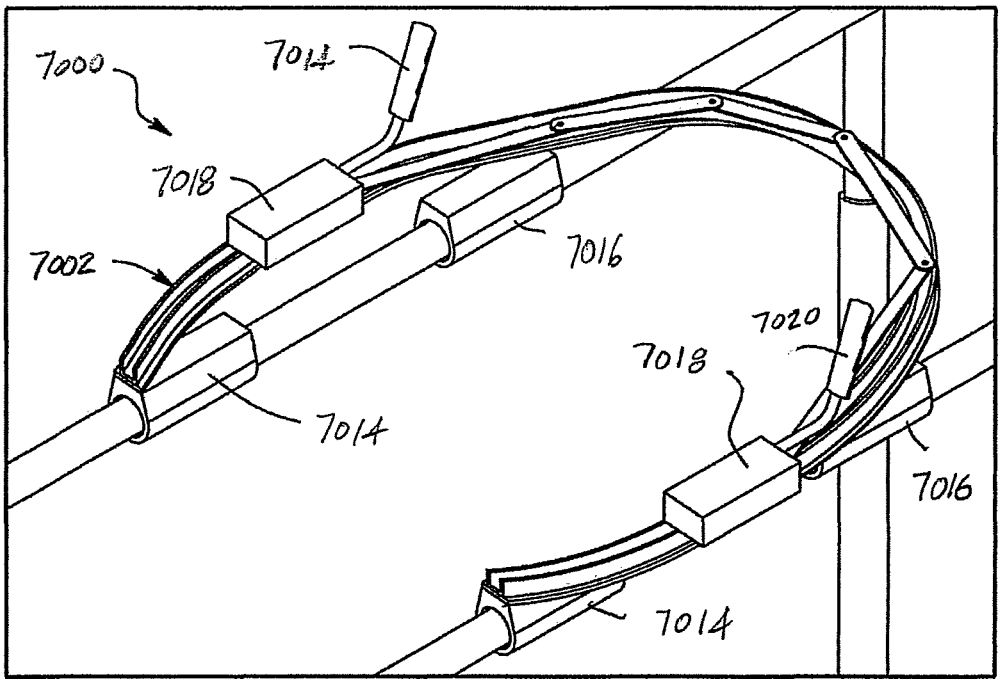
FIG. 17 shows a continuous curved track which could be incorporated instead of straight tracks and which is particularly well suited for incorporation of a push pull cable design of linkage.

FIGS. 16 and 17 provide curved tracks which can be attached to an upper portion of walker frame to enable rotational component of shoulder motion as the arm moves back and forth.

In FIG. 16, the track 7002 is curvilinear which introduces a rotatory component to movement of the shoulder joint, and which may be desirable when bilateral forearm supports are incorporated. Straight sagittal plane movement is facilitated with use of straight track(s)/rails and may be preferable when grip handles are incorporated. Tracks are stably positioned on top of walker frame member with device 7014, 7016 which serves to stably position the tracks in a selected position on the rail.

In FIG. 17, the track 7002 is secured to both rails (side frames of the walker), by two or more assemblies 7014, 7016. Piece 7018 glides along the track and provides the surface to which the various UE support surfaces are attached. A cable is connected to each of the two pieces and is securely mobilized through a housing which is or rests on a spanning member. Alternately, another connection between the assemblies is envisioned, via mobile components contained within or along the track. The track 7002 is curved such that greater degrees of freedom of movement of the shoulder can be accomplished as described above. Cane handle grips 7014 or forearm supports 7020 are shown as the support surface in this example.

It is also understood that the walker frame itself could be fabricated with discontinuous (FIG. 16) or continuous (FIG. 17) curved tube(s) upon which a mobile device such as FIG. 15 could glide.

Figure 18A:
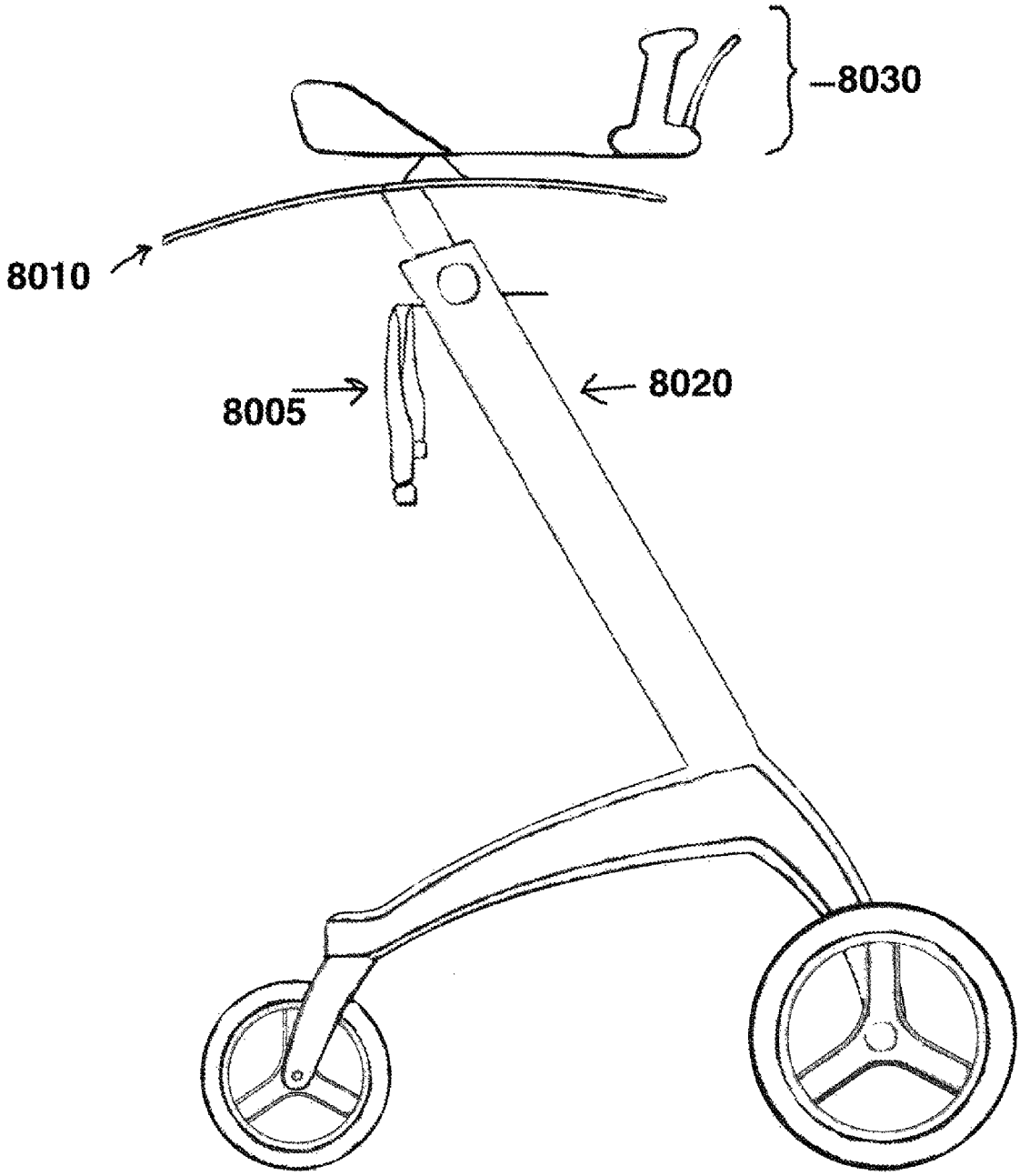
FIGS. 18A-18C show wheeled devices incorporating various frame designs and forearm support.
Figure 18B:
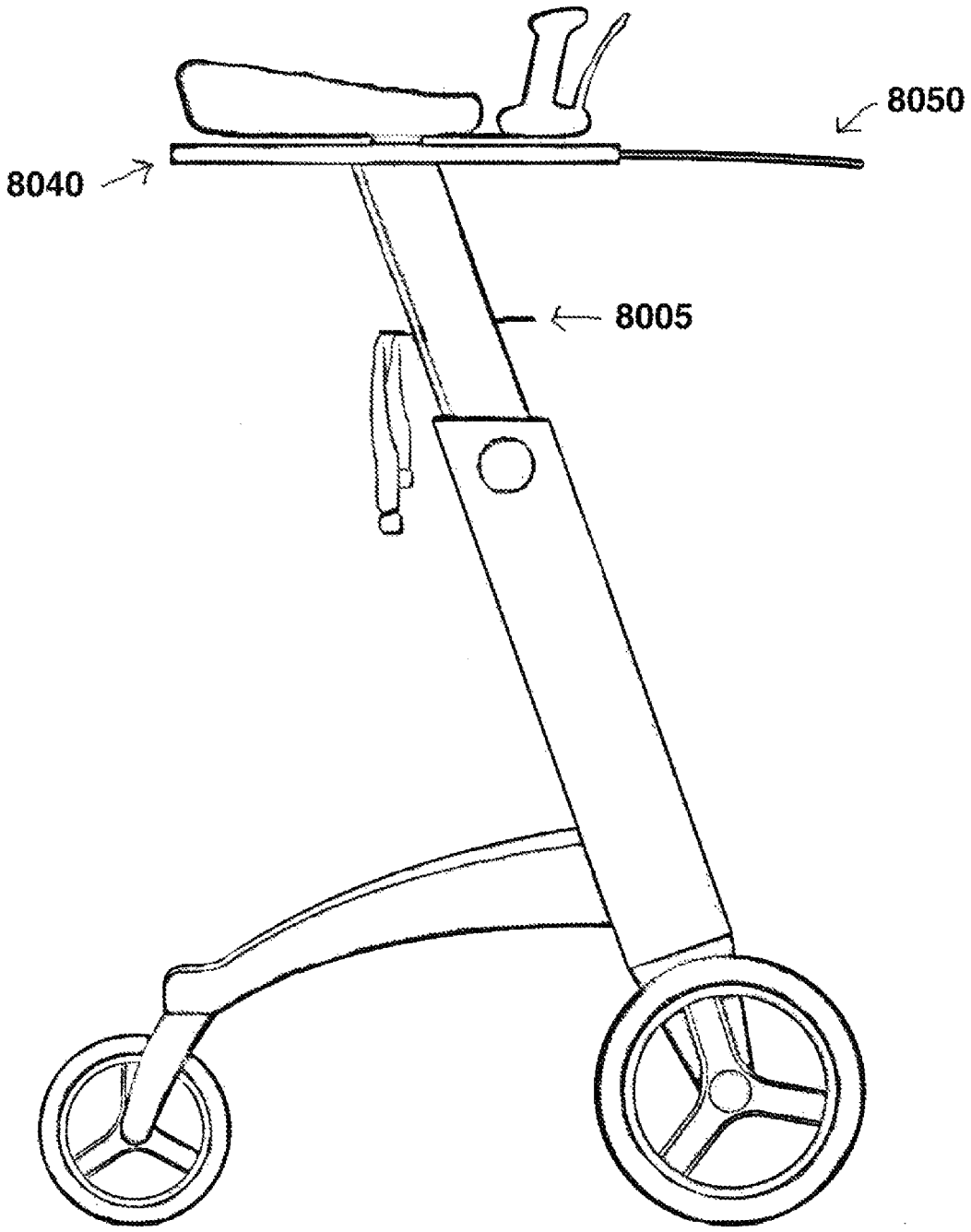
Figure 18C:
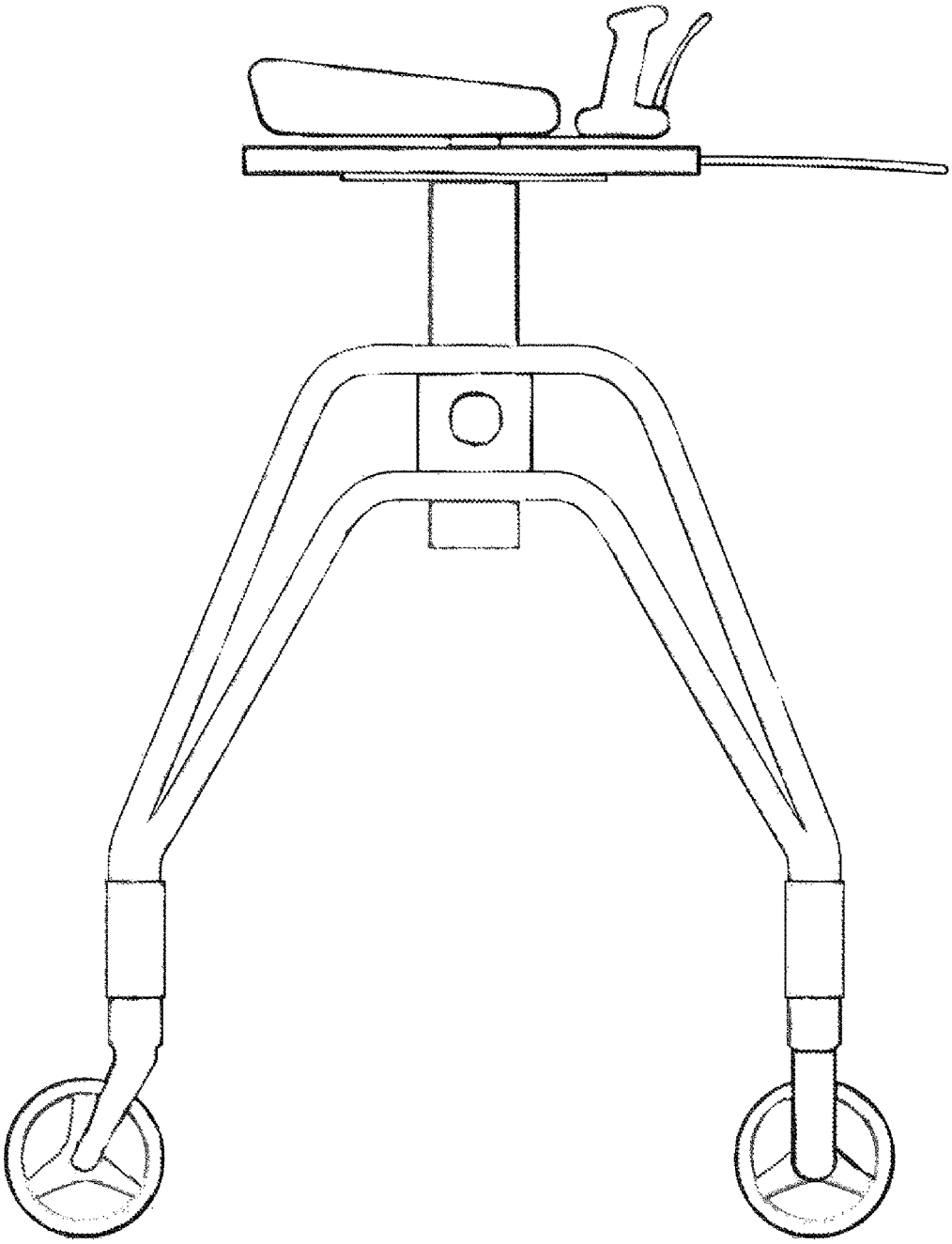

FIGS. 18A-18C show side views of rollators with four wheels. Caster wheels are in the rear. Forearm support assemblies are shown. Frame height is adjusted by telescoping tubes housed within the upright frame members. Torso bar and associated belt are identified as 8005.

A rollator particularly suited for fast walking training with flexed elbows is shown in FIG. 18A. Curved rails 8010 allow for addition of natural shoulder rotation during movement. A longer frame tube 8020 provides additional stability for more vigorous UE movement. A novel support assembly 8030 provides elbow support with attached grip handle and brake lever. A reverse motion linkage has been disconnected in order to enable independent movement of the UEs and associated assemblies.

FIG. 18B shows a rollator with straight rails 8040 and forearm support assembly. A forearm or grip handle could be introduced to the opposite side in FIGS. 18B and 18C as desired. Push pull cable 8050 for providing equal and opposite motion of assemblies is intact.

FIG. 18C shows a rollator particularly suited as a gait trainer with a longer wheel base for added stability. The push pull cable linkage is intact.

Figure 19:
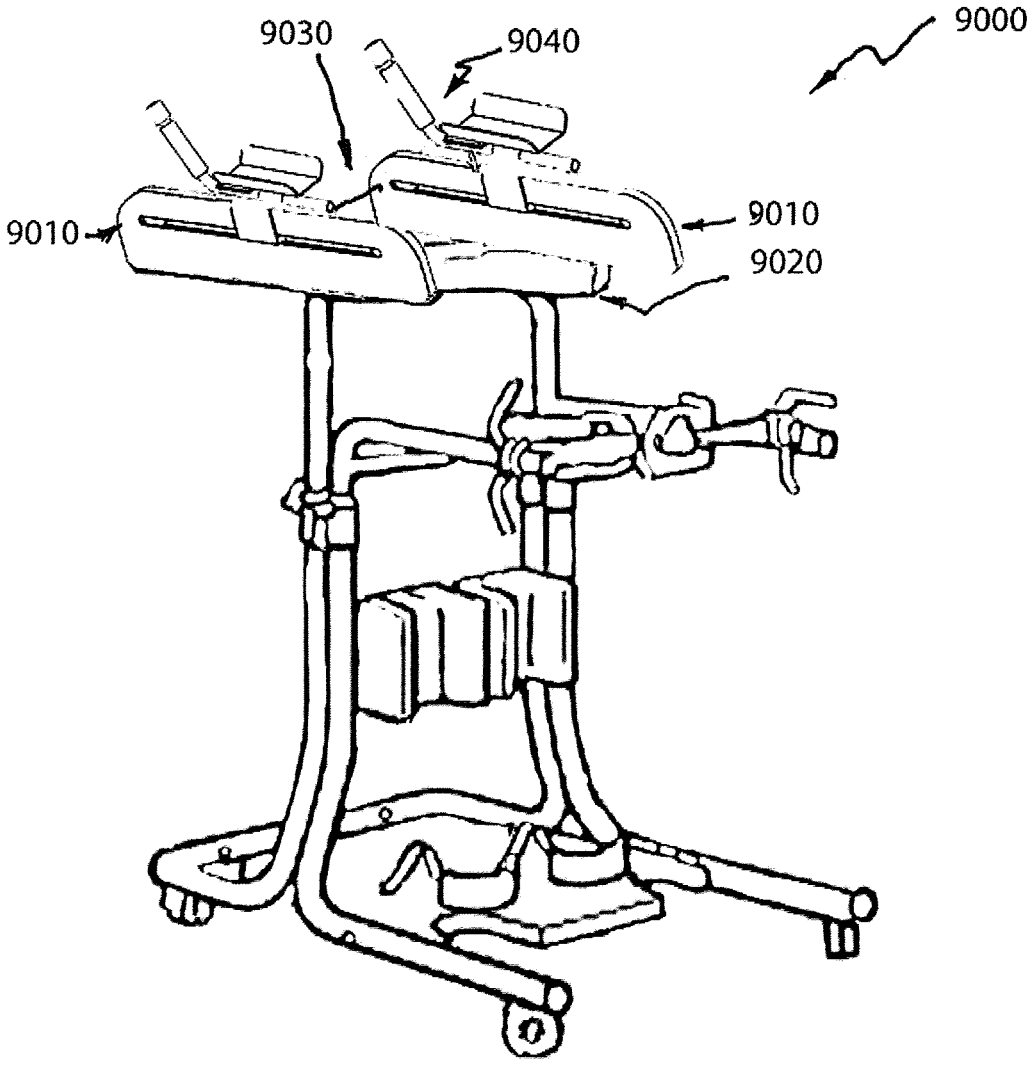
FIG. 19 illustrates a different type of wheeled device used for standing activities. Mobile UE assemblies connected with the belt and pulley linkage which is a component of second embodiment is incorporated in a standing frame.

FIG. 19 shows another type of wheeled device, namely, a standing frame. The components of the second walker embodiment which enable reciprocating UE movement have been introduced to the UE support surface on the standing frame to enable training in movement of one or both UEs during standing activities. Housings 9010 are positioned on each side of the support surface 9020. A coupling rod 9030 is positioned between housings. Forearm support assemblies 9040 are shown.

What is claimed:

1. A mobility aid that provides support for upper extremities of an associated user, the mobility aid comprising:

a frame having first and second laterally spaced sides spaced to receive an associated user therebetween;

at least first and second wheels operatively secured to and supporting the frame for selective rolling movement;

first and second upper extremity support assemblies located on upper portions of the first and second sides of the frame and each configured for movement forwardly/rearwardly in a generally longitudinal direction along and relative to the first and second sides of the frame, respectively, to enable forward and rearward movement of the associated users upper extremities;

a reverse motion linkage operatively associated with the first and second upper extremity support assemblies, the reverse motion linkage including a first state configured to enable independent movement between the first and second upper extremity support assemblies, and a second state configured to enable interrelated movement between the first and second upper extremity support assemblies; and a torso engaging member on the frame adapted for engagement with an associated user for advancing the mobility aid.

2. The mobility aid of claim 1 wherein the reverse motion linkage first state is configured to allow one or both of the first and second upper extremity support assemblies to be mobile and one or both of the support assemblies to move independently of one another to enable at least one of variable or similar distance, timing, or velocity of movement, and the reverse motion linkage second state is configured for interrelated equal movement, distance, and velocity in opposite directions of the first and second upper extremity support assemblies.

3. The mobility aid of claim 1 wherein in the second state of the reverse motion linkage, each of the first and second upper extremity support assemblies move back and forth along respective sides of the frame symmetrically in opposite directions so that as the first upper extremity support assembly moves forwardly or rearwardly relative to the first side of the frame, the second upper extremity support assembly moves symmetrically rearwardly or forwardly relative to the second side of the frame, respectively, to enable symmetrical out of phase movement of the upper extremities of an associated user.

4. The mobility aid of claim 1 wherein the movement of the upper extremity support assemblies is either linear, or curvilinear.

5. The mobility aid of claim 1 wherein the first and second upper extremity support assemblies include one of a first grip/grip handle on the first upper extremity support assembly for selective gripping by an associated first hand of the associated user and a second grip/grip handle for selective gripping by an associated second hand of the associated user, or a first forearm support assembly dimensioned to receive at least a portion of an associated forearm of the associated user and the first forearm support assembly further includes a first grip handle for selective gripping by an associated first hand of the associated user and a second grip/grip handle for selective gripping by an associated second hand of the associated user, or a first forearm support assembly dimensioned to receive at least a portion of an associated first forearm of the associated user and the first forearm support assembly includes a first grip for selective gripping by an associated first hand of the associated user, and a second forearm support assembly dimensioned to receive at least a portion of an associated second forearm of the associated user and includes a second grip handle for selective gripping by an associated second hand of the associated user.

6. The mobility aid of claim 1 further comprising a brake assembly operatively connected to (i) one or both of the first and second wheels for braking one or both of the first and second wheels, or (ii) one or both of the first and second upper extremity support assemblies for braking one or both of the first and second upper extremity support assemblies relative to the respective side of the frame, or (iii) one or both of the first and second wheels for braking one or both of the first and second wheels and one or both of the first and second upper extremity support assemblies for braking one or both of the first and second upper extremity support assemblies relative to the respective side of the frame.

7. The mobility aid of claim 1 wherein the reverse motion linkage includes first and second flexible drive members operatively connected to the first and second support assemblies, respectively, and first and second flexible drive members are interconnected to one another for synchronized movement therebetween.

8. The mobility aid of claim 1 further comprising an adjustment member whereby a position of at least one of the first and second support assemblies relative to a respective frame is adjustable in the reverse motion linkage second state whereby the travel distance of first and second mobile assemblies upon respective sides of the frame is adjustable.

9. The mobility aid of claim 1 wherein the reverse motion linkage includes a coupling shaft operatively associated with the first and second upper extremity support assemblies and selectively disconnectable from operative association with at least one of the first and second upper extremity support assemblies whereby the first and second upper extremity support assemblies move in equal and opposite forward and rearward directions when the coupling shaft is connected to the first and second upper extremity support assemblies, and the first and second upper extremity support assemblies move independently when the coupling shaft is disconnected from at least one of the first and second upper extremity support assemblies.

10. The mobility aid of claim 1 further comprising at least one stop block operatively associated with at least one of the first and second upper extremity support assemblies to limit movement of the at least one of the first and second upper extremity support assemblies in at least one direction forwardly or rearwardly relative to the respective side of the frame.

11. The mobility aid of claim 1 further comprising a track configured for receipt on the at least one of the first and second sides of the frame that cooperates with at least one of the first and second upper extremity support assemblies for selective translation of the at least one of the first and second support assemblies therealong.

12. The mobility aid of claim 11 wherein the track is either linear or curvilinear.

13. The mobility aid of claim 1 wherein in the second state of the reverse motion linkage, the first and second upper extremity support assemblies are configured for repetitive synchronized equal movement in opposite directions forwardly and rearwardly relative to respective first and second sides of the frame by a motor.

14. The mobility aid of claim 1 further comprising first and second pulleys, respectively, on the first and second sides of the frame and a belt that forms a continuous loop about each of the first and second pulleys, a mounting member for sliding along the rail and operatively associated with the belt, and the first and second pulleys are interconnected by a shaft to coordinate equal movement in opposite directions of the upper extremity support assemblies.

15. The mobility aid of claim 1 further comprising a push pull cable having portions of which are received in first and second hollow tubes secured to first and second sides of the frame, respectively, and an elongated slot in each tube that receives a sliding component extending therethrough, and the first and second upper extremity supports are secured to the sliding component of the first and second sliding components, respectively.

16. A mobility aid that provides support for upper extremities of an associated user, the mobility aid comprising:

a frame having first and second sides;

at least first and second wheels operatively secured to and supporting the frame for selective rolling movement;

first and second upper extremity support assemblies located on the first and second sides of the frame, respectively the first and second upper extremity support assemblies are configured for one of the following functions relative to the first and second sides of the frame, respectively (i) the first upper extremity support assembly is able to reciprocate, move forwardly/rearwardly relative to and along the first side of the frame and the second upper extremity support assembly does not move relative to the second side of the frame, or (ii) the first upper extremity support assembly is able to move in forward and rearward directions relative to and along the first side of the frame and the second upper extremity support assembly is able to move in forward and rearward directions relative to and along the second side of the frame and the first and second upper extremity support assemblies move independently of each other, or (iii) the first and second upper extremity support assemblies move equally in opposite directions, forwardly/rearwardly, rearwardly/forwardly, respectively, each relative to and along the respective first and second sides of the frame.

17. A mobility aid that provides support for upper extremities of an associated user, the mobility aid comprising:

a frame having first and second sides;

at least first and second wheels operatively secured to and supporting the frame for selective rolling movement;

first and second upper extremity support assemblies located on first and second sides of the frame, respectively, the first and second upper extremity support assemblies configured for selective sliding movement forwardly/rearwardly on a horizontal plane, relative to and along the respective first and second sides of the frame, to enable sagittal plane movement of first and second upper extremities of an associated user;

and a torso engaging member on the frame adapted for engagement with an associated user for managing, advancing and turning, of the mobility aid.

18. The mobility aid of claim 17 further comprising a reverse motion linkage operatively associated with the first and second upper extremity support assemblies for synchronizing equal movement of the first and second upper extremity support assemblies in opposite directions relative to one another and to the frame, wherein the reverse motion linkage includes a disengaged first state configured to allow one or both of the first and second upper extremity support assemblies to be mobile and the upper extremity support assemblies move independently of one another and an engaged second state configured such that the first and second upper extremity support assemblies have an interrelated, equal movement in opposite directions, enabling symmetrical reciprocating, out of phase, upper extremity movement of the associated user.

19. The mobility aid of claim 17 wherein the first and second support assemblies include one of (i) a first grip/grip handle on the first support assembly for selective gripping by an associated first hand of the associated user and a second grip/grip handle for selective gripping by an associated second hand of the associated user, or (ii) a first forearm support assembly dimensioned to receive at least a portion of an associated first forearm of the associated user and the first forearm support assembly includes a first grip handle for selective gripping by an associated first hand of the associated user, and a second grip/grip handle for selective gripping by an associated second hand of the associated user, or (iii) a first forearm support assembly dimensioned to receive at least a portion of an associated first forearm of the associated user and the first forearm support assembly including a first grip handle for selective gripping by an associated first hand of the associated user and a second forearm support assembly dimensioned to receive at least a portion of an associated second forearm of the associated user and the second forearm support assembly further including a second grip handle for selective gripping by an associated second hand of the associated user.

20. The mobility aid of claim 17 further comprising a brake assembly operatively connected to (i) one or both of the first and second wheels for braking one or both of the first and second wheels, (ii) one or both of the first and second support assemblies for braking one or both of the first and second support assemblies relative to the frame, or (iii) one or both of the first and second wheels for braking one or both of the first and second wheels and one or both of the first and second support assemblies for braking one or both of the first and second support assemblies relative to the frame.

21. The mobility aid of claim 16 further comprising a torso engaging member on the frame adapted for engagement with an associated user for advancing the mobility aid.

22. The mobility aid of claim 16 wherein the movement of one or both of the support assemblies is either linear, or along a curved path.

23. The mobility aid of claim 16 wherein the first and second support assemblies includes one of (i) a first grip on the first support assembly for selective gripping by an associated first hand of the associated user and a second grip for selective gripping by an associated second hand of the associated user, (ii) a first forearm support of the first forearm support assembly that is dimensioned to receive at least a portion of an associated forearm of the associated user and the first forearm support assembly further including a first grip handle for selective gripping by an associated first hand of the associated user, and a second grip for selective gripping by an associated second hand of the associated user, or (iii) a first forearm support of the first forearm support assembly dimensioned to receive at least a portion of an associated first forearm of the associated user and the first forearm support assembly includes a first grip handle for selective gripping by an associated first hand of the associated user, and a second forearm support of the second forearm support assembly dimensioned to receive at least a portion of an associated second forearm of the associated user and the second forearm support assembly includes a second grip handle for selective gripping by an associated second hand of the associated user.

24. The mobility aid of claim 16 further comprising a brake assembly operatively connected to (i) one or both of the first and second wheels for braking one or both of the first and second wheels, (ii) one or both of the first and second support assemblies for braking one or both of the first and second support assemblies relative to the respective side of the frame, or (iii) one or both of the first and second wheels for braking one or both of the first and second wheels and one or both of the first and second support assemblies for braking one or both of the first and second support assemblies relative to respective first and second sides of the frame.

25. The mobility aid of claim 1 further comprising a mechanism that varies a resistance to movement of the first and second upper extremity support assemblies relative to the first and second sides, respectively, of the frame.

26. The mobility aid of claim 1 further comprising first and second mobile components received on the first and second sides of the frame, respectively, and that receive the first and second upper extremity support assemblies, respectively.

* * * * *